United States Patent [19]

Ebata et al.

[11] Patent Number: 4,575,052

[45] Date of Patent: Mar. 11, 1986

[54] APPARATUS FOR CONTINUOUSLY QUENCHING A STEEL PLATE

[75] Inventors: Sadao Ebata; Seiji Bando, both of Kurashiki, Japan

[73] Assignee: Kawasaki Steel Corporation, Hyogo, Japan

[21] Appl. No.: 625,635

[22] Filed: Jun. 28, 1984

Related U.S. Application Data

[62] Division of Ser. No. 438,528, Nov. 1, 1982, abandoned.

[30] Foreign Application Priority Data

| | | | |
|---|---|---|---|
| Nov. 19, 1981 | [JP] | Japan | 56-185664 |
| Nov. 20, 1981 | [JP] | Japan | 56-186325 |
| Nov. 27, 1981 | [JP] | Japan | 56-190063 |
| Nov. 27, 1981 | [JP] | Japan | 56-176336 |
| Dec. 10, 1981 | [JP] | Japan | 56-3564 |
| Dec. 10, 1981 | [JP] | Japan | 56-3565 |
| Dec. 22, 1981 | [JP] | Japan | 56-207388 |
| Dec. 22, 1981 | [JP] | Japan | 56-207389 |
| Jan. 11, 1982 | [JP] | Japan | 57-2100 |
| Jan. 11, 1982 | [JP] | Japan | 57-2101 |

[51] Int. Cl.[4] ..... C21D 1/64

[52] U.S. Cl. ..... 266/81; 266/88; 266/114; 266/117; 266/131

[58] Field of Search ..... 266/111-112, 266/114, 117, 130, 131, 133, 134, 81, 87, 88

[56] References Cited

U.S. PATENT DOCUMENTS

| | | | |
|---|---|---|---|
| 3,410,734 | 11/1968 | Taylor | 148/153 |
| 3,423,254 | 1/1969 | Safford et al. | 148/153 |
| 3,531,334 | 9/1970 | Schrader et al. | 148/153 |
| 3,546,911 | 12/1970 | Lenz | 148/153 |
| 3,604,696 | 9/1971 | Coleman et al. | 266/117 |
| 3,885,581 | 5/1975 | Dahon et al. | 134/122 |
| 3,990,257 | 11/1976 | Taylor et al. | 62/63 |
| 4,149,703 | 4/1979 | Safford | 266/117 |
| 4,298,188 | 11/1981 | Germain | 266/114 |
| 4,371,149 | 2/1983 | Takeuchi et al. | 266/90 |
| 4,415,143 | 11/1983 | Ebata | 266/112 |

FOREIGN PATENT DOCUMENTS

| | | | |
|---|---|---|---|
| 41317 | 3/1982 | Japan | 148/143 |
| 415314 | 10/1974 | U.S.S.R. | 266/112 |

*Primary Examiner*—Christopher W. Brody
*Attorney, Agent, or Firm*—Parkhurst & Oliff

[57] ABSTRACT

A method of and apparatus for continuously quenching a steel plate with cooling water, by passing the steel plate through a water storage vessel containing the cooling water. The cooling water for cooling the upper side of the steel plate is introduced into the upper section of the water storage vessel from an upper portion of the latter and is exhausted from an upper portion of the same through, for example, overflow. The cooling water for cooling the lower side of the steel plate is introduced into the lower section of the water storage vessel from a lower portion of the latter and exhausted from a lower portion of the same. The cooling water is agitated and moved by impellers disposed in the upper and lower sections of the storage vessel in the direction of movement of the steel plate or in the direction opposite to the direction of movement of the steel plate which is clamped and fed linearly through the water storage vessel by means of upper and lower rolls. The water for cooling the upper side of the steel plate is circulated only through the upper section of the water storage vessel while the water for cooling the lower side of the steel plate is circulated only through the lower section of the water storage vessel.

31 Claims, 29 Drawing Figures

APPARATUS FOR CONTINUOUSLY QUENCHING A STEEL PLATE

This is a Division of application Ser. No. 438,528 filed Nov. 1, 1982, now abandoned.

BACKGROUND OF THE INVENTION

1. Field of the Invention

The present invention relates to a method and apparatus for continuously quenching a steel plate by introducing the steel plate into a coolant vessel.

2. Description of the Prior Art

In order to increase the rate of cooling of a steel plate to effectively quench the steel plate, it is necessary to increase the relative velocity between the surface of the steel plate and a cooling water. To this end, a typical conventional cooling apparatus employs a cooling water jet for jetting pressurized cooling water from nozzles into collision with the steel plate surface.

This cooling apparatus, however, inconveniently increases the size of the quenching system as a whole because of the necessity of equipment for pressurizing the cooling water to a high pressure, and consumes massive cooling water uneconomically. In consequence, the production cost and running cost of the quenching system are raised undesirably. The increase of the cooling water consumption rate also requires a larger size of the cooling water pipes occupying large space, which in turn necessitates larger height and length of the quenching system as a whole requiring suitable reinforcement of the frame and the like for supporting the increased weight of the cooling water pipes and other internal structures. In addition, the increased size of the cooling water pipes is inevitably accompanied by an increase in the pitch of rows of the cooling pipes arranged in a side-by-side fashion, which in turn makes it difficult to increase the density of water jets and, hence, to obtain higher cooling effect. Furthermore, it has been often experienced that the cooling water nozzles are clogged to provide an uneven quenching effect. Once the clogging of the nozzles occur, much time and money are required for recovering the uniform distribution of water jets.

In order to overcome these problems, the present inventors have already proposed, in Japanese Patent Application No. 167102/1972 corresponding to the International Patent Application No. PCT/JP 81/00356, a continuous steel plate quenching apparatus having a water storage vessel through which the steel plate is made to run so as to be cooled by the cooling water, and impellers disposed in the vessel and adapted to displace the cooling water in the direction of running of the steel plate or, alternatively, in the direction opposite to the direction of running of the steel plate.

This continuous steel plate quenching apparatus will be explained hereinunder with specific reference to FIGS. 1 to 4.

FIG. 1 is a side elevational view of the continuous steel plate quenching apparatus proposed in the aforementioned Patent application, while FIGS. 2 and 3 are sectional views taken along the lines II—II and III—III of FIG. 1, respectively. The essential part of the apparatus is shown in a larger scale in FIG. 4.

Referring first to FIG. 1, the continuous steel plate quenching apparatus has a cooling water storage vessel 10 provided in its opposing walls with openings 14 for permitting a steel plate 12 to be quenched to pass therethrough. The vessel 10 accomodates rolls 16 and rolls 18 arranged in rows at the upper and lower sides of the path of the steel plate 12 and adapted to clamp the steel plate 12 from the upper and lower sides of the latter to feed the same in the direction of arrow C. The rolls 16 and 18 are adapted to be driven rotatingly in the directions of arrows A and B, respectively, by driving devices 28 and 30 (see FIG. 2). The cooling water storage vessel 10 is filled with cooling water 42 supplied through water supplying main pipes 64 and 66. A plurality of impellars 32, each having a plurality of blades 40 and an axis parallel to the rolls 16, are arranged in a row such that each impeller 32 takes position between each pair of adjacent rolls 32. Similarly, impellers 34 are disposed between adjacent rolls 18. The impellars 32 and 34 are adapted to be driven in the directions of arrows D and E, respectively, by driving devices 52 and 54 (see FIG. 3) so as to agitate the cooling water. In order to effect an efficient agitation of the cooling water, the impellers 32 and the impellers 34 are housed by respective housings 56 and 58 each of which are opened at its position facing the steel plate to be cooled.

The rolls 16 and 18, which are arranged in respective rows at a suitable pitch as shown in FIG. 1, are rotatably supported at their both ends by bearings 20 and 22, respectively, as will be best seen from FIG. 2. The axes of the rolls 16 and 18 are held horizontally and are extended in the breadthwise direction of the water storage vessel 10. One end of each of the rolls 16 and 18 are extended beyond the bearing 20 or 22 to the outside of the vessel 10. The extended ends are drivingly connected through couplings 24 and 26 to the aforementioned driving devices 28 and 30 so that the rolls 16 and 18 are driven by these driving devices. Namely, the rolls 16 of the upper row are rotatingly driven in the direction of arrow A while the rolls 18 of the lower row are made to rotate in the opposite direction as shown by arrow b, so that the steel plate 12 to be quenched, clamped between these rows of rolls, are driven continuously in the longitudinal direction of the water storage vessel 10.

An upper water supplying pipe 74 and a lower water supplying pipe 74 are disposed externally of the water storage vessel 10 in the vicinity of each opening 14, at the upper side and lower side of the passage of the steel plate 12. Each water supplying pipe 74 has a slit nozzle 76 directed toward the opening 1. In operation, pressurized water 78 is jetted from the slit nozzle 76 towards the opening 14 to form a water seal around the opening 14.

In this quenching system, the impeller housings are connected to respective main water supplying pipes 64,66 through branch pipes 60,62, so that the quenching system as a whole is made complicated and expensive although it is improved to some extent as compared with conventional systems. In addition, the cooling water tends to flow in the breadthwise direction of the steel plate 12 as indicated by arrows L,M and N in FIG. 2, so that the uniform cooling of the water in the breadthwise direction may fail. Furthermore, since all of the water supplied into the water storage vessel 10 overflows from the upper edges of said walls, an upward flow of water is formed in the water storage vessel 10 so that different cooling effects are developed on the upper surface and lower surface of the steel plate.

It is to be pointed out also that, as will be seen from FIG. 4, although the rotation of the impeller 32 produces the flow of cooling water, the flow of cooling water on the surface of the steel plate is only effected at the lower side of the impeller 32 and the water thereafter flows over the roll 16 in the direction indicated by arrow J, so that no substantial cooling effect is produced on the portion of the steel plate 12 just beneath the roll 16. Namely, the rolls 16 and 18, which are flat rolls, make line contact with the steel plate 12 along the length of these rolls, so that the flow of cooling water in the longitudinal direction of the water storage vessel, produced by each impeller, is blocked by the roll and is deflected upwardly, i.e. away from the surface of the steel plate 12, as indicated by arrow J. Therefore, the flow of water is weakened in the region where the steel plate 12 is contacted by the rolls 16 and 18, resulting in a lowered quenching efficiency.

The present inventors, through a series of experiment, found out that the cooling water stagnates around the base portions of the blades 40, i.e. around the juncture between the blades 40 and the shafts 36,38 of the impellers because the water in such region can hardly be mixed with the newly supplied cold water, although the replacement with newly supplied water takes place vigorously in the region around the radial outer ends of the blades. In consequence, the temperature of water stagnant around the shafts is rotated following up the rotation of the shafts 36,38 without making any contribution to the cooling of the steel plate. Furthermore, when air bubbles or voids which are happened to be contained by the supplied cooling water are introduced into the regions around the shafts 36,38 where the blades 40 are jointed to these shafts, the water containing the air bubbles or voids undesirably stagnates in these regions to make it difficult to discharge the air bubbles to the outside of the water storage vessel 10. This phenomenon inconveniently raises the temperature of the cooling water to seriously deteriorate the cooling performance. The air bubbles or voids stagnant around the base ends of the blades 40 cause various further problems such as reduction in efficiency of use of the cooling water, increase in the resistance against rotation of the blades and, hence, increase in the driving power, as well as corrosion of the impellers.

In this quenching system in which the water storage vessel is always filled with cooling water, a forced cooling is effected leaving the cooling power of so-called dip cooling, even when the impellers are not rotated. It is, therefore, rather difficult to apply this quenching system when the quenching is to be made in a controlled manner at a comparatively small cooling rate. On the other hand, a quenching system employing two-fluid jetting nozzles has been known in which jets of mixture of water and compressed air are applied to the material to be quenched in the air. In this cooling system, the rate of water jet and, therefore, the cooling power can be adjusted and controlled over a wide range so that it is possible to impart any desired mechanical properties to the steel in accordance with the use and kind of the steel, through suitably selecting the cooling rate. On the other hand, however, it is necessary to use a large quantity of compressed gas and to employ a source of cooling water of high pressure, in order to attain high quenching efficiency with this quenching system. This is quite disadvantageous from economical point of view and may incur a rise of the production cost.

In the aforementioned quenching system incorporating the impellers 32,34, only a small gap on an order of several tens of millimeters or less is left between the radially outer ends of the blades 40 and confronting surfaces of the steel plate 12, while the impellers are rotating during quenching. Therefore, when the steel plate 12 is happened to be warped or deflected during quenching, the blades 40 may be accidentally contacted by the blades 40 to cause breakdown of the impellers 32,34. It is conceivable even that the steel plate 12 cannot be passed through the clearance between the upper and lower impellers 32 and 34, due to an excessively large warp or deflection. The steel plate 12, which is accidentally contacted by the blades 40 of the impellers 32,34, is seriously damaged at the contacted surface or surfaces.

It is to be pointed out also that, in this quenching system, it is not possible to treat a steel plate of a thickness exceeding the thickness of the opening 14. To the contrary, a too small thickness of the steel plate makes it difficult to form the water seal around the opening 14.

In the quenching system of the type described, it is often required to pass a hot steel plate without effecting any quenching on the steel sheet. In such a case, the upper structures such as upper rolls 16, upper impellers 32, upper impeller housings 56 and so forth are shifted upwardly away from the passage of the hot steel plate thereby to prevent heating of these structures by the heat radiated from the hot steel plate, as well as the collision by the steel plate. In this state, the upper slit nozzles 76 are also moved upwardly apart from the passage of the hot steel plate. Under such a condition, the steel plate is conveyed solely by the lower rolls 18. Any excessive heating of the lower rolls 18 and the lower impellers 34 of the quenching system by the heat from the hot steel plate is prevented by filling the lower portion of the water storage vessel 10 up to such a level as not to reach the steel plate 12, i.e. below the pass line. The overheating of the lower slit nozzles 76 is also prevented by jetting cooling water through the lower slit nozzles at such a rate that the jets of water from the lower slit nozzles do not reach the steel plate. On the other hand, the upper structures such as upper rolls 16, upper impellers 32 and so forth are inevitably subjected to the heat radiated from the steel plate and, therefore, are heated to a temperature of 100° C. or higher but thermal distorsion of these structures can be avoided by rotating them during passing of the hot steel plate. However, the upper slit nozzles 76, which also are subjected to the heat radiated from the hot steel plate, cannot effectively be cooled because they cannot be rotated nor supplied with cooling water unlike the lower slit nozzles 76. Namely, if the cooling water is jetted from the upper slit nozzles 76, the steel plate which is not intended for quenching is undesirably cooled by the cooling water to locally change its property resulting in a serious deterioration in the quality of the steel plate. Therefore, in the known quenching system of the type described, when the hot steel plate which is not to be quenched is made to pass through the quenching line, the upper slit nozzles 76 are excessively heated to high temperature by the heat radiated from the steel plate to make thermal distorsion resulting in a change in the pitch of the upper slit nozzles or alternatively the nozzles as a whole are bent or deformed. This inconveniently causes a disturbance in the pattern of jet of the cooling water when the water jet is started for the next quenching operation. With such a disturbed water jet pattern, it is not possible at all to attain the expected quenching effect.

SUMMARY OF THE INVENTION

Accordingly, it is a primary object of the invention to provide a quenching method and apparatus which is improved to uniformalize the quenching effect along the breath of a steel plate and equalizing the quenching effects on the upper and lower sides of the steel plate, while simplifying the construction of the quenching apparatus without being accompanied by increase of the size of the quenching apparatus as a whole.

To this end, according to the invention, there is provided a method for continuously quenching a steel plate by continuously cooling the steel plate with cooling water, comprising the steps of: feeding the steel plate into and through a water storage vessel containing circulated cooling water; supplying the cooling water for quenching substantially an upper portion of the steel plate from an upper portion of the water storage vessel and exhausting the same from the upper portion of the cooling water vessel; supplying the cooling water for quenching substantially a lower portion of the steel plate from a lower portion of the cooling water vessel and exhausting the same from the lower portion of the cooling water vessel; and moving the cooling water on both surfaces of the steel plate in such a manner as to prevent the vertical flow of the cooling water across the level of the steel plate. According to an aspect of the invention, the vertical flow of the cooling water is prevented by suitably adjusting the amount of supply and exhaustion of the cooling water upon detect of any vertical flow.

It is another object of the invention to provide a continuous quenching method for quenching steel plate which is improved to provide larger rate of flow of the cooling water in the regions near the surfaces of the steel plate thereby to ensure higher quenching efficiency.

To this end, according to the invention, there is provided a continuous quenching apparatus in which so-called disc rolls having a plurality of discs fitted on the periphery of a cylindrical shaft at a suitable pitch along the length of the shaft are used in place of flat rolls having a constant cross-section perpendicular to the axes thereof, for clamping and feeding the steel plate. According to this arrangement, the steel plate is contacted only by the peripheral surfaces of the discs during the feeding thereof, leaving ample spaces between the steel plate surface and the peripheral surfaces of the shafts, to permit the cooling water to move through such spaces at a large flow rate.

It is still another object of the invention to provide a continuous quenching apparatus for quenching a steel plate in which the cooling water is moved not only in the direction of rotation of the impellers but also in the breadthwise direction of the steel plate within such a range as not to cause any lack of uniformity of quenching effect in the breadthwise direction of the steel plate, thereby to avoid substantial stagnation of the cooling water and air bubbles or voids around the shafts of impellers, i.e. around the base portions of the blades at which the blades are connected to the shafts.

To these ends, according to another aspect of the invention, each impeller has a plurality of blades which are mounted on a rotary shaft at a substantially constant pitch along the length of the shaft, wherein each blade is disposed along a hypothetical plane which crosses a hypothetical plane containing the axis of the shaft of the impeller at an angle of less than 30 degree as viewed in the direction perpendicular to the axis of the shaft, so that each blade produces a flow component of the cooling water in the axial direction of the impeller.

It is a further object of the invention to provide a continuous quenching apparatus for quenching a steel plate which can provide remarkable improvements in the efficiency of use of the cooling water and the precision of the quenching operation.

To this end, according to the invention, the quenching apparatus is provided with a means for maintaining the cooling water temperature in the water storage vessel at a constant level.

It is a still further object of the invention to provide a continuous quenching apparatus for quenching steel plate which is improved to overcome the disadvantage in the performance and economy of the apparatus in the heat treatment at high quenching rate and to permit a large controllability to afford an increase in the quenching capacity.

To this end, according to a further aspect of the invention, two-fluid jet nozzles for simultaneously jetting water and a compressed gas are employed. According to this arrangement, it is possible to selectively apply the dip quenching and the two-fluid jet quenching. It is also possible to effect a quenching at high efficiency by dipping with the assist of the gas jet which affords a control of the quenching effect. Accordingly, the quenching effect can be controlled over a wide range by a comparatively simple equipment.

It is still further object of the invention to provide a continuous quenching apparatus for quenching a steel plate, improved to avoid any damage of steel plate surfaces and impeller blades attributable to the contact therebetween due to any warping or deflection of the steel plate during quenching.

To this end, according to the invention, a plurality of rings are attached to the shaft of each impeller, the rings having a diameter greater than that of a circle drawn by the outmost tips of the blades when the impellers rotate.

It is a still further object of the invention to provide a continuous quenching apparatus for quenching a steel plate, capable of effecting efficient quenching on the steel plate of a variety of thicknesses.

To this end, according to the invention, the quenching apparatus is into an upper section and a lower section along the feeding passage of the steel plate to be quenched, and means are provided for permitting a change in the distance between two sections with flexible seal members connected between two sections, thereby to permit the size of the openings to be changed in accordance with the change in the thickness of the steel plate to be quenched.

It is a still further object of the invention to provide a continuous quenching apparatus for quenching a steel plate, improved to protect upper structures such as upper slit nozzles of the quenching apparatus from the heat radiated by the steel plate, when the steel plate in hot state which is not intended for quenching is made to pass through the quenching apparatus.

To this end, according to the invention, the quenching apparatus is provided with a nozzle protecting cover having a length at least equal to the length of a cooling water jetting slit nozzle provided on the upper half part of the quenching apparatus at at least the inlet side of the latter, the nozzle protecting cover being pivotable by a driving device mounted on an upper frame of the apparatus, wherein, when the quenching is not conducted, the nozzle protecting cover is interposed between the slit nozzle and the upper surface of the steel plate running through the quenching apparatus so as to protect the slit nozzle from the heat radiated by the steel plate.

In order to protect the upper structures of the quenching system, the invention proposes also to provide a plurality of blowing windows in the ceiling of the water storage vessel, and a blower mounted on the vessel and connected to the blowing windows through ducts. In operation, cold air is blown into the upper part of the water storage vessel so that a temperature of the atmosphere in the upper part of the vessel is maintained sufficiently low to prevent any thermal distortion of the upper structures of the quenching apparatus which may for otherwise be caused by the heat radiated from the hot steel plate.

In order to prevent any thermal distortion of the ceiling of the water storage vessel, dams are formed around the cooling water exhausting openings and windows in the ceiling plate, so that water is pooled on the upper surface of the ceiling thereby to effectively cool the ceiling.

The above and other objects, features and advantages of the invention will become clear from the following description of the preferred embodiments taken in conjunction with the accompanying drawings.

DESCRIPTION OF THE PREFERRED EMBODIMENTS

Figure 1:
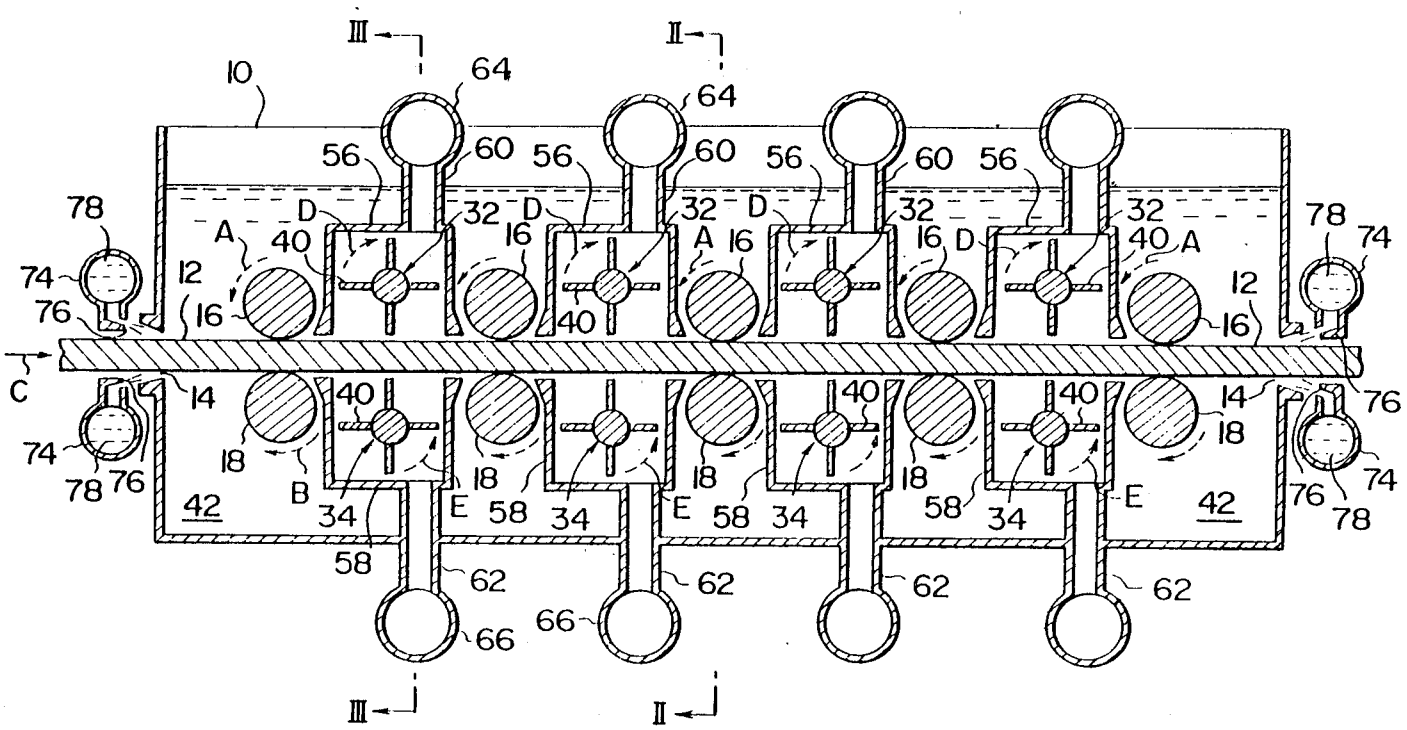
FIG. 1 is a sectional side elevational view of a continuous steel plate quenching apparatus of a preceding Patent application.
Figure 2:
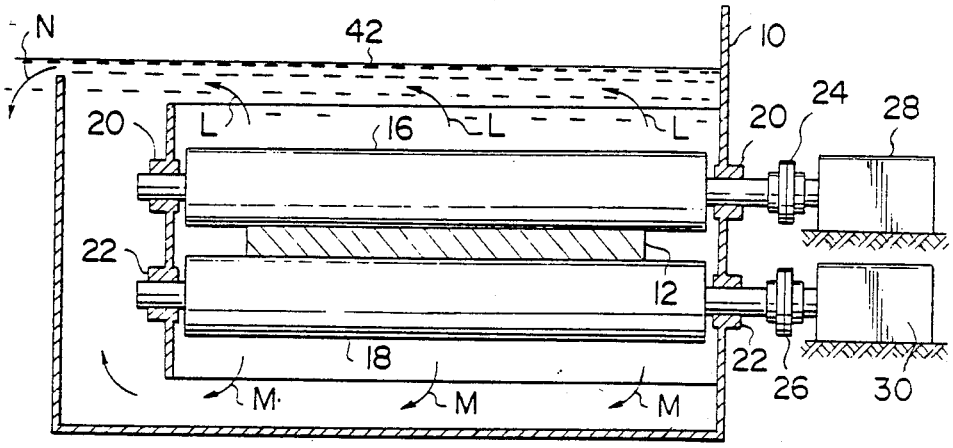
FIG. 2 is a sectional view taken along the line II—II of FIG. 1.

Preferred embodiments of the invention will be described hereinunder with reference to the accompanying drawings in which the same reference numerals are used to denote the same parts or members as those in the prior art explained before in connection with FIGS. 1 thru 4.

Figure 5:
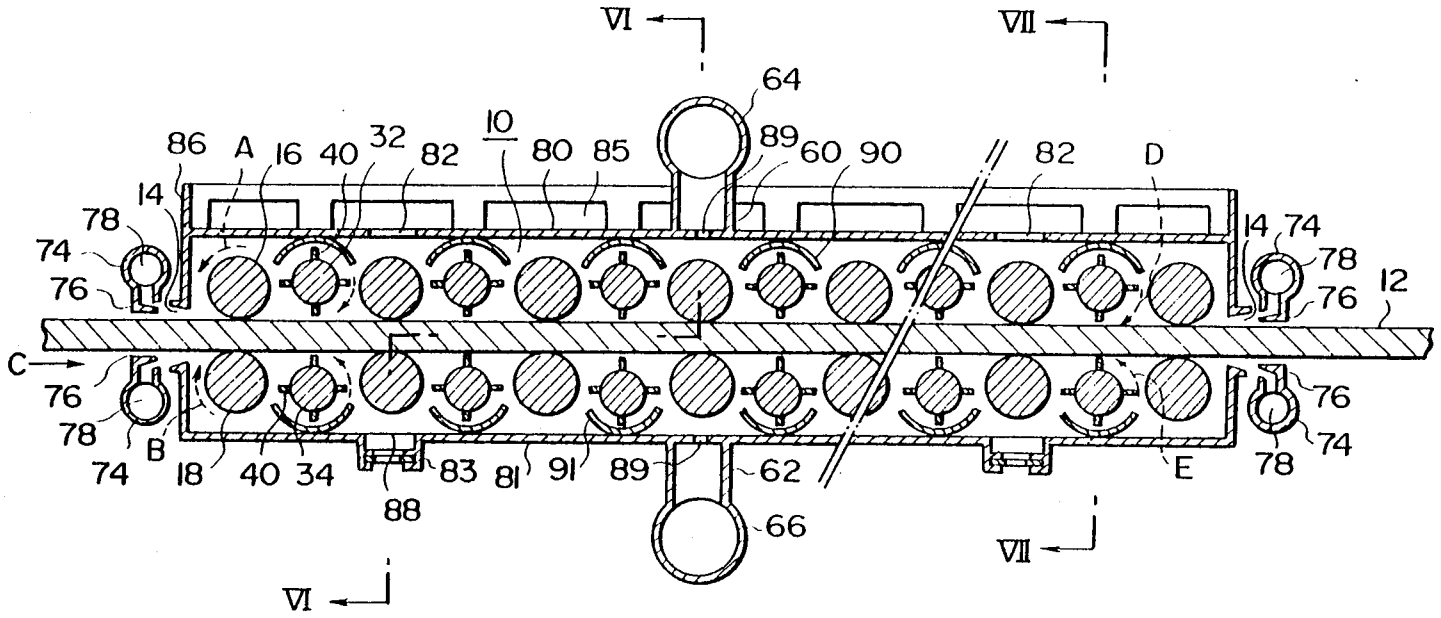
FIG. 5 is a sectional view illustrating a method of and apparatus for quenching a steel plate in accordance with an embodiment of the present invention.

Referring first to FIG. 5 showing a continuous steel plate quenching apparatus of a first embodiment, the quenching apparatus has a water storage vessel 10 through which a steel plate 12 is made to run in the horizontal direction and rapidly cooled by the cooling water in the vessel 10 so as to be quenched. The steel plate 12 gets into the vessel 10 through a rectangular opening 14 provided in one longitudinal end of the vessel 10 and comes out of the storage vessel through another rectangular opening 14 formed in the other longitudinal end of the vessel. Water supplying pipes 74 are disposed outside of the water storage vessel 10 at the upper side and lower side of the passage of the steel plate 12 at each rectangular opening 14 which constitutes an entrance or exit for the steel plate 12. These water supplying pipes run in parallel with main water supplying pipes 64 and are connected to slit nozzles 76. In operation, pressurized water 78 from a water source (not shown) is injected towards each opening 14.

Figure 6:
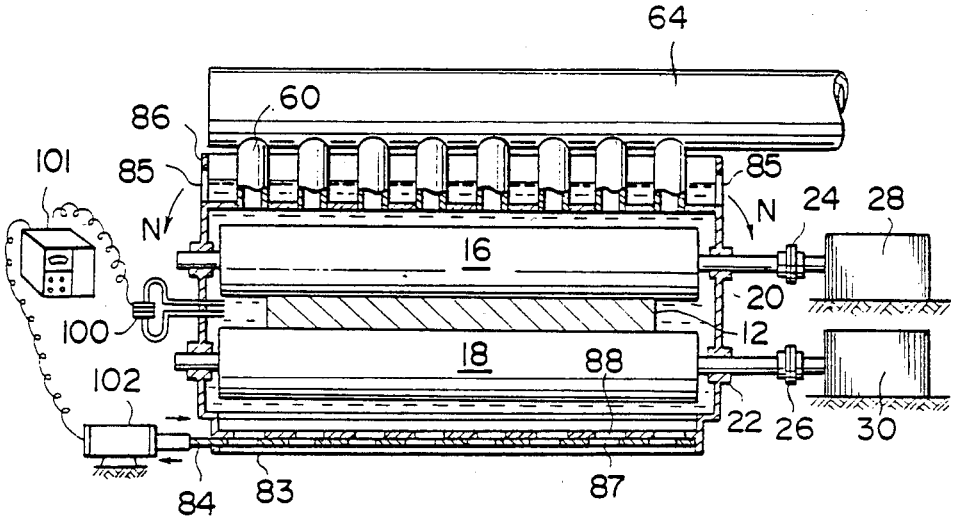
FIG. 6 is a sectional view taken along the line VI—VI of FIG. 5.

As will be seen also from FIG. 6, a plurality of upper rolls 16 and lower rolls 18 are disposed in the water storage vessel 10. These rolls are rotatably supported at their both ends by respective bearings 20 and 22. These rolls 16,18 have horizontal axes extended in the direction perpendicular to the direction of the longitudinal axis of the water storage vessel 10. These rolls 16 and 18 have one end extended beyond the bearings 20,22 to the outside of the water storage vessel 10 and connected to driving devices 28,30 through couplings 24,26, so that the rolls 16 and 18 are rotatingly driven by these driving devices independently in opposite directions. Namely, the upper rolls 16 rotate in the direction of arrow A while the lower rolls 18 rotate in the direction of arrow B in FIG. 3, so that the steel plate 12 clamped therebetween is fed in the longitudinal direction of the water storage tank 10 as indicated by arrow C.

Figure 3:
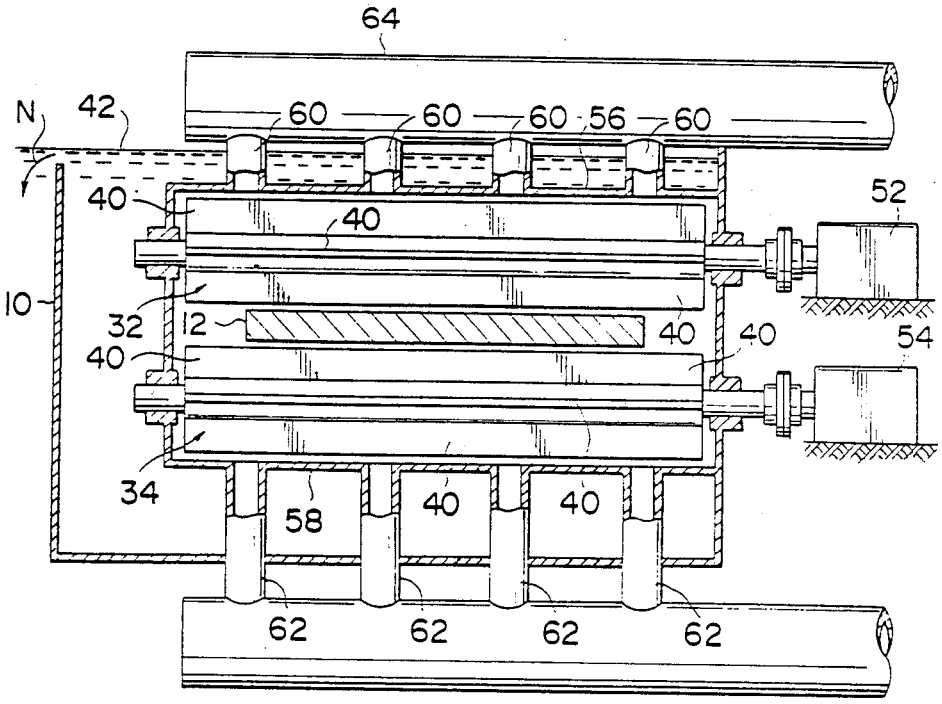
FIG. 3 is a sectional view taken along the line III—III of FIG. 1.
Figure 4:
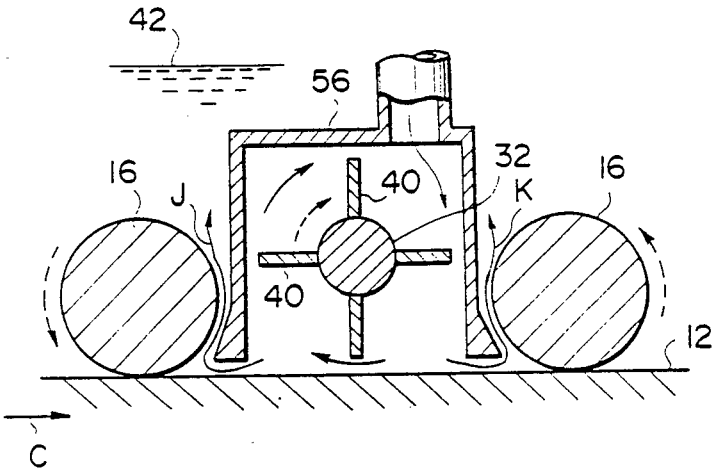
FIG. 4 is an enlarged view of an essential part of the apparatus shown in FIG. 1.

The quenching apparatus has a plurality of upper impellers 32 disposed such that one upper impeller 32 is positioned between two adjacent upper rolls 16. Similarly, a plurality of lower impellers 34 are disposed such that one lower impeller takes a position between two adjacent lower rolls 18. The upper and lower impellers 32 and 34 have axes parallel to the axes of the upper and lower rolls 16 and 18. As shown in FIGS. 3 and 5, the impellers 32 and 34 have rotary shafts 36 and 38 from which radialy projected are four blades 40 at a constant circumferential pitch. A gap of less than several tens of millimeters is left between the outmost tip of the blade 40 and the confronting surface of the steel plate 12 thereby to prevent lack of uniformity of quenching attributable to the flow of the cooling water in the direction of axis of the impeller, i.e. in the breadthwise direction of the steel plate fed through the water storage vessel 10.

Figure 7:
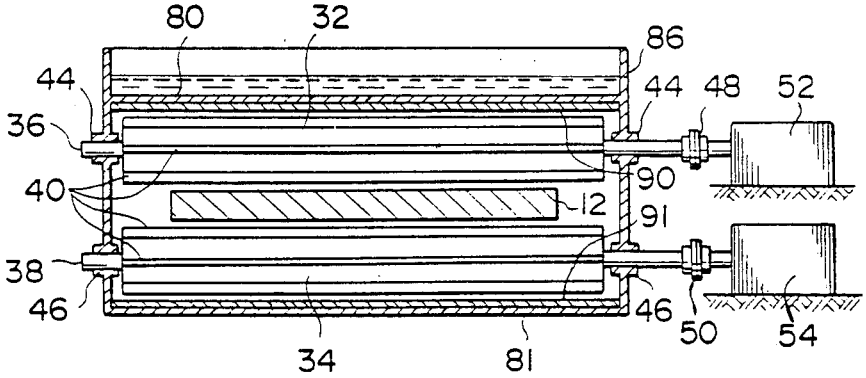
FIG. 7 is a sectional view taken along the line VII—VII of FIG. 5.

The rotary shafts 36 and 38 of the impellers 32 and 34 as shown in FIG. 7 are supported by bearings 44 and 46 and extend through the bearings to the outside of the vessel 10, where the rotary shafts are connected to driving devices 52 and 54 through couplings 48 and 50. These driving devices are adapted to drive the impellers 32 and 34 in the directions opposite to the directions of rotations of the associated rolls. Namely, the upper impellers 32 rotate in the direction opposite to the direction of rotation of the upper rolls 16 as indicated by an arrow D, while the lower impellers 34 are rotated in the direction opposite to the direction of rotation of the lower rolls 18 as indicated by arrow E. As a result of rotation of the impellers, the cooling water is moved in the direction opposite to arrow C in which the steel plate 12 is moved, at each side of the steel plate 12. The driving power of the driving devices 52 and 54 are so selected that the peripheral speeds of the impellers 32 and 34 is 2m/sec or higher with respect to the steel plate 12. At the upper side of the upper impeller 32, disposed is an impeller guide 90 having an arcuate cross-section and fixed to the ceiling plate 80 of the water storage vessel 10. Similarly, an impeller guide 91 having an arcuate cross-section and fixed to the bottom plate 81 of the water storage vessel 10 is disposed at the lower side of the water storage vessel 10. These impeller guides 90 and 91 are adapted to rule the flow of cooling water around the impellers 32 and 34 thereby to effectively stir and agitate the cooling water when these impellers 32 and 34 rotate. A plurality of water supplying branch pipes 60 are arrayed in a row extending in the breadthwise direction of the steel plate 12 and are connected to water supplying openings 80 formed in the ceiling plate 80. Similarly, a plurality of water supplying branch pipes 62 arranged in a row extending in the breadthwise direction of the steel sheet are connected to water supplying openings 89 formed in the bottom plate 81 of the water storage vessel 10. The water supplying branch pipes 60 are connected at their other ends to a common water supplying main pipe 64. Similarly, the water supplying branch pipes 62 are connected at their other ends to another common water supplying main pipe 66. These water supplying main pipes are connected to a source of the cooling water through flow rate adjusting valves which are not shown. The water supplying branch pipes 60,62, therefore, supply the cooling water from the source into the water storage vessel 10. The size of the water supplying pipes 64,66 and the number of the branch pipes 60,62 are suitably selected so as to ensure the supply of cooling water uniformly in the breadthwise direction of the water storage vessel 10 so as to effect uniform cooling over the entire breadth of the steel plate. The rate of supply of the cooling water from the cooling water source is selected to be large enough to prevent any substantial temperature rise by the heat removed transferred from the hot steel plate thereby to ensure sufficient quenching effect. The pressure of the cooling water may be on the order of 0.5 $Kg/cm^2$ or so.

Overflow openings 82 having predetermined areas are formed at a constant pitch particularly in the breadthwise direction of the water storage vessel 10, in the ceiling plate 80 of the water storage vessel 10. The overflow openings permit the cooling water to overflow upwardly therethrough. Both side walls 86 of the water storage vessel 10 are extended upwardly beyond the level of the ceiling plate 80 so as to form a tub for receiving water on the ceiling plate 80. As shown in FIG. 6, water discharging windows 85,85 are formed in the extensions of the side walls 86 above the ceiling plate 80. The cooling water which has overflowed through the overflow openings 82 is discharged through the windows 85,85 laterally as indicated by arrow N.

The bottom plate 81 of the water storage vessel 10 is provided in suitable portions thereof with a plurality of water exhausting openings 88 arranged at a constant pitch particularly in the breadthwise direction of the water storage vessel 10. The opening areas of the water exhausting openings are adjustable by means of gates 83 attached thereto. More specifically, the gates are provided to project downwardly from respective water exhausting openings 88, and slidably hold adjusting plates 84 having openings of the same size and pitch as the water exhausting openings 88. It is, therefore, possible to change the opening areas of the water exhausting openings 88 uniformly in the breadthwise direction of the water storage vessel 10 by sliding the adjusting plates. Each adjusting plate 84 has one end extended externally through one side wall 86 of the water storage vessel 10 and connected to a driving device 102 for sliding the adjusting plate 84. The driving device 102 is driven through a controller 101 in accordance with the output from a water flow sensor 100. The water flow sensor 100 is extended through the side wall 86 of the water storage vessel 10 to take a level substantially the same as that of the steel plate 12, i.e. substantially mid point in the heightwise direction of the water storage vessel 10, and is adapted to detect any substantial vertical component of flow of cooling water in the water storage vessel 10 to produce an output in response to which the driving device 102 is activated. Although only one water flow sensor 100 suffices, a higher accuracy of control can be obtained by increasing the number of the water flow sensor. The controller 101 is connected also to the flow rate adjusting valves (not shown) in the water supplying main pipes 64,66 to effect the control of the rate of water supply.

In operation, the steel plate 12 is moved in the direction of arrow C by the power derived from the driving devices 28,30. At the same time, pressurized cooling water is forcibly supplied into the water storage vessel 10 from a water source through the cooling water supplying main pipes 64,66 and the branch pipes 60,62. Meanwhile, the impellers 32 and 34 are driven by respective driving devices 52,54 to agitate the cooling water thereby to effect the quenching. The steel plate 12 is fed by the rolls 16 and 18 without any slip on these rolls. Since the steel plate is clamped between the upper and lower rolls, there is no possibility of generation of quenching distortion in the steel plate. These rolls serve also to create symmetrical patterns of flow of cooling water at the upper and lower sides of the steel plate 12.

The cooling water mainly in the space on the upper side of the steel plate 12 (this space will be referred to as "upper section" of the water storage vessel) is supplied through the upper water supplying main pipes 64, upper water supplying branch pipes 60 and the water supplying openings 89 in the ceiling plate 80, and is agitated by the rotation of the impeller 32 so as to cool the upper side of the steel plate 12. The cooling water is then moved to the outside through the overflow openings 82 in the ceiling plate 80 and is discharged through the discharge windows 85 as indicated by arrows N. On the other hand, the cooling water mainly in the space under the steel plate 12 (this space will be referred to as "lower section" of the water storage vessel) is supplied through the lower water supplying main pipes 66, lower water supplying branch pipes 62 and the water supplying openings 89 in the bottom plate 81 and is agitated by the rotation of the lower impellers 34 thereby to cool the lower side of the steel plate. The water is then discharged through the water exhausting openings 88 in the bottom plate 81 and the gates 83. As a result, the cooling water for cooling the upper surface of the steel plate is circulated only at the upper side of the steel plate, while the cooling water for cooling the lower surface of the steel plate is circulated only at the lower side of the steel plate. In other words, there is no substantial vertical component of flow of water across the steel plate 12, so that the upper and lower surfaces of the steel plate are cooled at an equal cooling rate.

In some cases, however, a substantial vertical flow component of the cooling water is formed in the water storage vessel 10 by a change in the rates of supply and exhaustion of the cooling water. Such a vertical flow component is sensed by the water flow sensor 100. When a downward flow component of the cooling water in the water storage vessel 10 is sensed by the water flow sensor 100, it is judged that the rate of exhaustion of the cooling water from the lower section of the vessel is greater than the rate of supply of the cooling water into the same space. In this case, therefore, the rate of supply of the water to the lower section of the water storage vessel is increased through an adjustment of the flow rate adjusting valve in the lower water supplying main pipe 66 through the controller 101 or, alternatively, decreasing the rate of exhaustion of the cooling water from the lower section of the vessel through adjusting the opening areas of the water exhausting openings 88 by sliding the adjusting plates 84 by means of the driving devices 102, so as to equalize the rates of supply and exhaustion of the cooling water to and from the lower section of the water storage vessel, thereby to nullify the downward flow of the cooling water in the water storage vessel 10. The downward flow component of the cooling water is produced also when the rate of supply of the cooling water into the upper section of the water storage vessel exceeds the rate of exhaustion of the cooling water from the same. In such a case, the downward flow component of the cooling water can be nullified by decreasing the rate of supply of the cooling water through adjusting the flow rate adjusting valves in the upper water supplying main pipes 64 by means of the controller 101. To the contrary, when an upward flow component in the water storage vessel is sensed by the sensor 100, it is judged that a phenomenon opposite to that explained above is taking place. Therefore, the control is made to nullify this upward flow component by increasing the rate of exhaustion of the cooling water from the lower section through adjusting the opening areas of the water exhaustion opening 88 by means of the gates 83 or, alternatively, by reducing the rate of supply of the water to the lower section of the vessel through operating the flow rate adjusting valves in the lower water supplying main pipes or, still alternatively, by increasing the rate of supply of the cooling water to the upper section of the vessel through operating the flow rate adjusting valves of the upper water supplying main pipes. The rate of supply of the cooling water, however, is a factor which directly affects the quenching effect of the steel plate and, therefore, should be determined preferentially in accordance with the size of the steel plate and/or the kind of the steel. In the operation for eliminating the vertical flow component of the cooling water, therefore, a preference is given to the adjustment of the opening areas of the water exhausting openings 88 by means of the gates 83.

Figure 8:
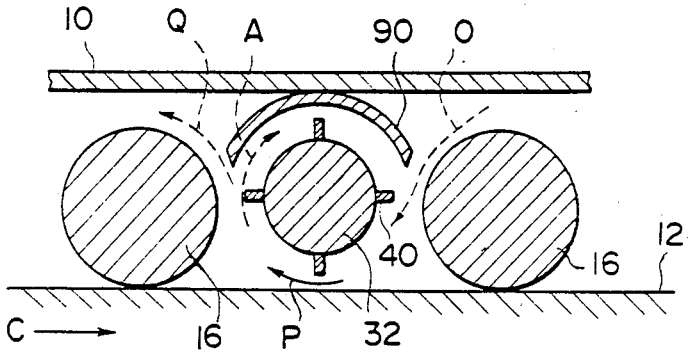
FIG. 8 is a sectional view showing in a larger scale an impeller and a portion around the impeller of the apparatus shown in FIG. 5.

As shown in FIG. 8, the cooling water is stirred and agitated drawing flow lines as indicated by arrows O,P and Q as a result of rotation of the impellers 32 and 34, so that the water moves in the counter direction to the direction of movement of the steel plate in contact with each surface of the latter. In contrast to the impeller housings 56,58 incorporated in the quenching apparatus of preceding Patent application explained in connection with FIG. 1, the impeller guides 90,91 cover smaller parts of the peripheries of the impellers 32,34, so that the flow of cooling water is smoothed to afford an efficient mixing of the cooling water heated by the heat from the steel plate and the newly supplied cooling water thereby to enhace to cooling power of the quenching apparatus as a whole. Therefore, it is possible to maintain the necessary cooling power with reduced number of water supplying main pipes. For instance, in the described embodiment, only one cooling water main pipe is provided for each of the upper section and lower section of the water storage vessel, in contrast to the known apparatus in FIG. 1 in which the number of the water supplying main pipes equals to that of the impellers at each side of the steel plate. Consequently, according to the invention, it is possible to remarkably simplify the construction of the quenching apparatus as a whole.

In addition, since the exhausting of the cooling water from the upper section and lower section of the water storage vessels is made through the overflow openings 82 and the water exhausting openings 88 which are formed in the ceiling plate 80 and the bottom plate 81, respectively, at a constant pitch in the breadthwise direction of the steel plate 12, i.e. in the breadthwise direction of the water storage vessel 10, no substantial flow of cooling water takes place in the breadthwise direction of the steel plate 12 within the water storage vessel 10, so that the quenching effect is uniformalized over the breadth of the steel plate.

As has been described, according to the invention, it is possible to prevent any vertical flow component and breadthwise flow component of the cooling water in the water storage vessel thereby to uniformalize the quenching effect over the entire part of the steel plate to ensure a superior quality of the quenched steel plate. In addition, the construction of the apparatus as a whole is simplified and the cost of the apparatus is lowered economically.

Figure 9:
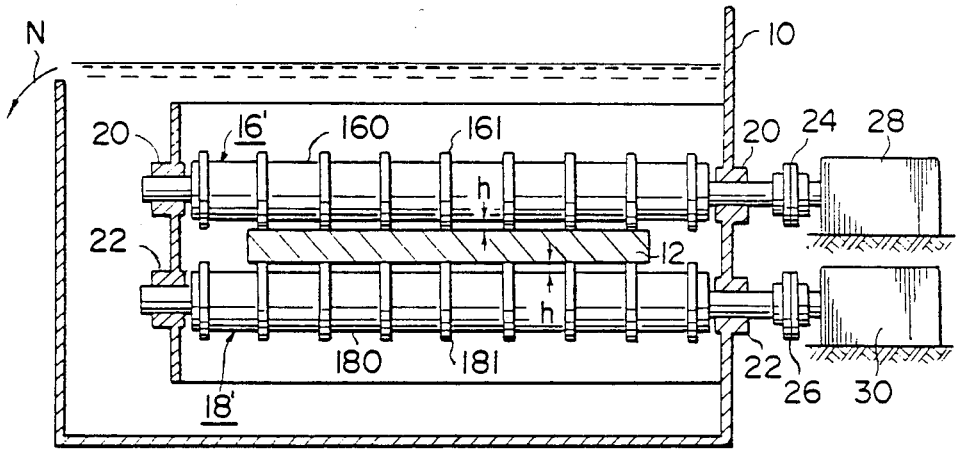
FIG. 9 is a sectional view of an essential part of a continuous steel plate quenching apparatus in accordance with a second embodiment of the invention showing particularly a roll incorporated in the apparatus.
Figure 10:
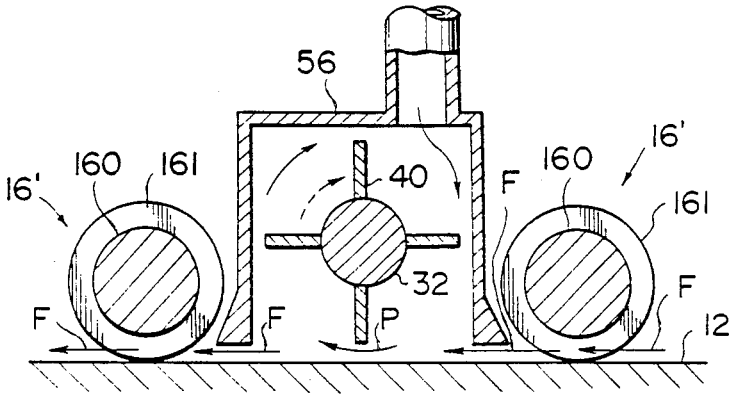
FIG. 10 is a view similar to that in FIG. 4 but showing the second embodiment shown in FIG. 9.

A continuous steel plate quenching apparatus in accordance with a second embodiment of the invention will be described hereinunder with reference to FIGS. 9 thru 11. This embodiment is different from the first embodiment shown in FIGS. 1 to 4 in that disc rolls 16' and 18' are used in place of the cylindrial rolls employed in the first embodiment. As shown in FIG. 9, the disc rolls 16' and 18' have plurality of rings 161 and 181 mounted on a cylindrical central shafts 160,180 concentrically with these shafts, at a suitable interval or pitch in the axial direction. During the quenching, the steel plate is contacted and clamped by these rings 161 and 181. In consequence, gaps of a height h, which corresponds to the radial height of the rings 161 and 181 are formed between the outer peripheral surfaces of the central shafts 160,180 of the rolls and the associated surfaces of the steel plate 12. Therefore, the flow of water P produced by the rotation of the impeller 32 is allowed to move in the longitudinal direction of the water storage vessel 10 as indicated by and arrow F in FIG. 10. This means that the flow rate of the cooling water flowing in contact with the steel plate surfaces is largely increased to remarkably improve the cooling efficiency.

Figure 11:
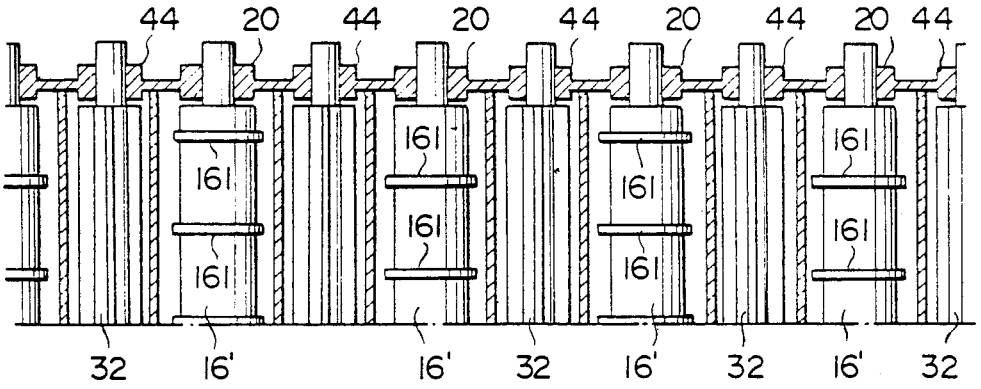
FIG. 11 is a partly omitted plan view of the embodiment shown in FIG. 9.

FIG. 11 is a horizontal sectional view of this embodiment, showing particularly the arrangement of the rings on the disc rolls 16' (18'). As shown in FIG. 11, the positions of the rings on two disc rolls 16' which face each other across an impeller 32 are staggered from each other in the axial directions of these rolls. The same applies to the arrangement of the rings 181 on the lower rolls 18'. In the embodiment shown in FIG. 11, the axial positions of the rings of every two disc rolls coincide with each other although the axial positions of rings are offset or staggered in the adjacent rolls as explained before. The axial positions of the rings of the upper disc rolls and those of the rings on the lower disc rolls vertically aligned with these rolls coincide with each other. In the described embodiment, therefore, the positions of the contact between the rings 161,181 of the rolls 16',18' and the steel plate 12 are varied as the steel plate is moved ahead so that the quenching effect is uniformalized over the breadth of the steel plate.

Furthermore, since the cooling water displaced by the impellers 32,34 is allowed to flow strongly along the surfaces of the steel plate 12 as in the case of the regions around the upper and lower disc rolls, so that the effective cooling area is increased to remarkably improve the efficiency of use of the cooling water, as well as the cooling capacity. Accordingly, it is possible to reduce the consumption of the cooling water to further lower the cost of production of the quenched steel plate.

Figure 12:
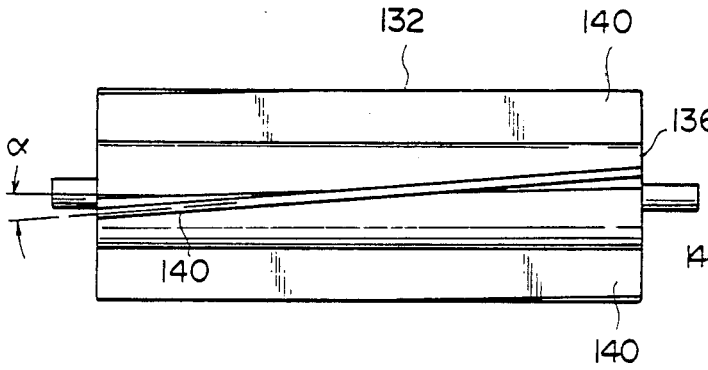
FIG. 12 is an enlarged front elevational view of a steel plate continuous quenching apparatus in accordance with a third embodiment of the invention showing particularly an impeller.
Figure 13:
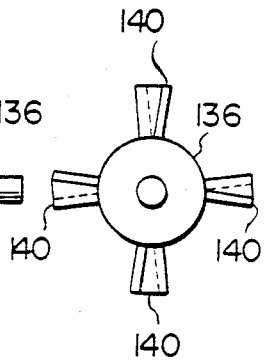
FIG. 13 is a side elevational view of the impeller shown in FIG. 12.
Figure 14:
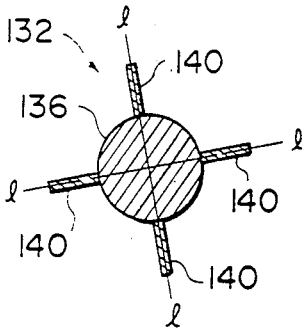
FIG. 14 is a sectional view of the impeller shown in FIG. 12 taken along a line perpendicular to FIG. 12.

FIGS. 12 to 15 in combination show a continuous steel plate quenching apparatus in accordance with a third embodiment of the invention having a different form of the impeller. Referring first to FIGS. 12 to 14, a plurality of, e.g. four blades, 140 are mounted on the outer peripheral surface of the rotary shaft 136 at a substantially constant circumferential pitch, along the length of the rotary shaft. The blades 140 are attached to the rotary shaft 136 at a twisting angle $\alpha$ of less than 30°, with respect to a hypothetical plane containing the axis of the rotary shaft 136. Therefore, as shown particularly in FIG. 14, the impeller 132 has such a section perpendicular to the axis of the rotary shaft 136 that the neutral line 1 of each blade always intersects the axis of the rotor shaft 136. When the impeller 132 having the spiral blades 140 are used, the twisting angle $\alpha$ should be not smaller that 2 degree because such a small twisting angle cannot produce any substantial effect and should be not greater than 15 degree because such a large twisting angle $\alpha$ increases the displacement of the cooling water in the longitudinal direction of the impeller, i.e. in the breadthwise direction of the steel plate, resulting in a quenching distortion along the breadth of the steel plate. The twisting angle $\alpha$, therefore, should be selected to range between 2 degree and 15 degree.

Figure 15:
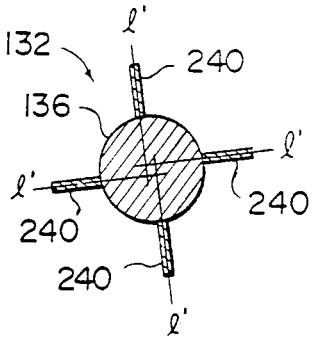
FIG. 15 is a sectional view of another example of the impeller taken at the same plane as that in FIG. 14.

As an alternative, when the twisting angle $\alpha$ is not greater than 10 degree, it is not always necessary to make the blade have a spirally curved surface. For instance, as shown in FIG. 15, if is possible to provide a flat blade 240 along a hypothetic plane which crosses the aforementioned hypothetical plane containing the axis of the rotary shaft 136 at an angle not greater than 10 degree. In this case, the rotary shaft 136 exhibits a sectional shape perpendicular to the axis of the rotary shaft 136 as shown in FIG. 14 at the longitudinal mid portion of the impeller 132. In other portions, however, the neutral line 1' of the blade 140 does not cross the axis of the rotary shaft 136 at all, but disturbance of the cooling water does not occur because the angle of crossing of the blade 140 is not greater than 10 degree.

In the continuous steel plate quenching apparatus of the type described, the cooling water is displaced in the direction of movement of the steel plate or in the opposite direction at a predetermined relative speed with respect to the steel plate. At the same time, water is displaced also in the breadthwise direction at such a small rate as not to cause any unevenness of the quenching in the breadthwise direction of the steel plate. In consequence, the undesirable stagnation of the cooling water and air voids around the outer peripheral surface of the rotary shaft 136 to which the blades 140,240 are atached is avoided, and the water and air voids are displaced therefrom in the axial direction of the impeller so as to be discharged to the outside of the water storage vessel.

As has been described, according to this embodiment of the invention, it is possible to avoid lack of uniformity in the quenching effect in the breadthwise direction of the steel plate attributable to stagnation of the cooling water and air voids in the area around the peripheral surface of the impeller shaft, because the cooling water and air voids are smoothly moved from such region and mixed with the newly supplied cooling water of lower temperature. It is, therefore, possible to eliminate disadvantages atributable to the stagnation of cooling water and air voids such as reduction in the cooling efficiency and increase of resistance against the rotation of the impeller.

Figure 16:
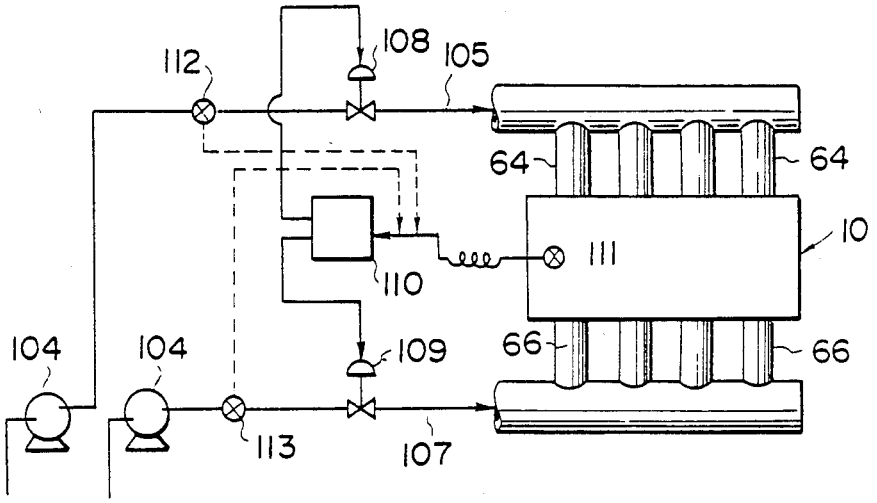
FIG. 16 is a system diagram of a continuous steel plate quenching apparatus in accordance with a fourth embodiment of the invention.
Figure 17:
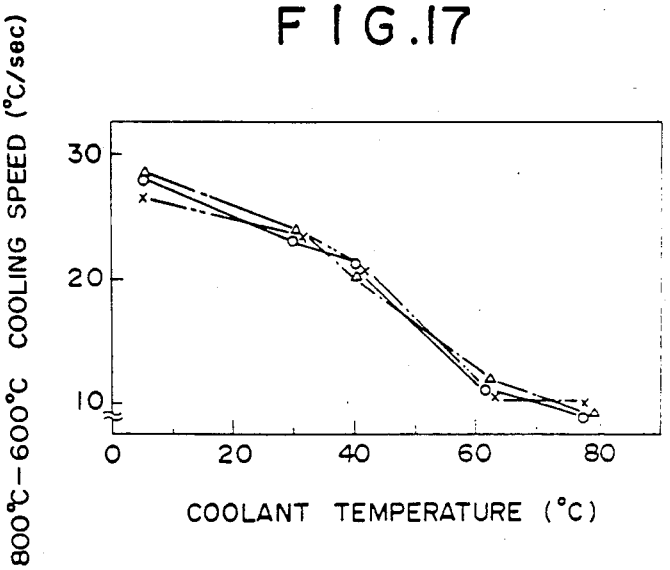
FIG. 17 is a graph showing the relationship between cooling water temperature and cooling power in the embodiment shown in FIG. 16.

FIGS. 16 and 17 in combination show a fourth embodiment of the invention. Referring to FIG. 16, the continuous steel plate quenching apparatus of this embodiment has a water storage vessel of the same type as that described before. An upper water supplying main pipe 64 and a lower water supplying main pipe 66 are connected to the water storage vessel 10. A water supplying means consisting of a pump 104 and a pipe 105 is connected to the main water supplying pipe 64. Similarly, a water supplying means including a pump 106 and a pipe 107 is connected to the water supplying main pipe 66. Flow rate adjusting devices 108 and 109 are provided at intermediate portions of the pipes 105 and 107, respectively. The flow rate adjusting devices 108 and 109 are adapted to be opened and closed under the control of a controller 110 which in turn operates in response to signals from a water temperature detector 111 disposed in the water storage vessel and water temperature detectors 112 and 113 in the pipes 105 and 107, in such a manner as to maintain a predetermined water temperature in the water storage vessel 10. In the operation of the quenching apparatus, the temperature of the water in the water storage vessel 10 is inevitably raised due to contact with the hot steel plate. The water temperature is detected by the water temperature detector 111 and a signal representing the water temperature is delivered to the controller 110. When the detected water temperature is higher than a predetermined set temperature, the controller 110 delivers a signal for increasing the rate of supply of the cooling water to the flow rate adjusting devices 108 and 109. To the contrary, when the detected temperature is lower than the predetermined temperature, the controller 110 delivers a signal for decreasing the rate of supply of the cooling water to the flow rate adjusting devices 108 and 109.

The predetermined temperature of the cooling water set beforehand in the controller 110 can be changed to any desired value automatically or manually in accordance with the kind of the steel to be quenched.

In the described embodiment of the invention, it is possible to input not only the water temperature in the water storage vessel 10 but also temperatures of the supplied cooling water detected by the water temperature detectors 112,113. By so doing, it is possible to achieve higher accuracy of the water temperature control. It is also possible to use two or more water temperature detectors for detecting the water temperature in the water storage vessel 10. In the described embodiment, the water in the water storage vessel 10 is continuously exhausted by a suitable exhausting means such as overflow system (not shown) provided in the side walls of thre water storage vessel 10, as the cooling water is supplied into the vessel 10.

An experiment conducted by the present inventors showed that, in the quenching apparatus of the described embodiment, there is a close ralationship between the temperature of the cooling water in the water storage vessel 10 and the cooling power or capacity as shown in FIG. 17 and, hence, it is possible to effect quite an efficient quenching by adequately controlling the temperature of the cooling water in the water storage vessel 10 to permit free setting of the cooling conditions in accordance with the kind of the steel thereby to permit the production of the quenched steel plate of high quality. In the experiment for obtaining the test result shown in FIG. 17, a steel SUS304 of 28 mm thick was used as the testing material.

According to the described embodiment, it is possible to maintain a constant water temperature in the water storage vessel comparatively easily and to effect the quenching with optimum rate of supply of the cooling water at a high cooling efficiency. It is, therefore, possible to produce quenched steel plate at a comparatively low cost. Furthermore, the cooling power can be adjusted over a wide range by changing the cooling water temperature, so that the cooling condition can be varied over a wide range to ensure superior quality of the quenched steel plate.

Figure 18:
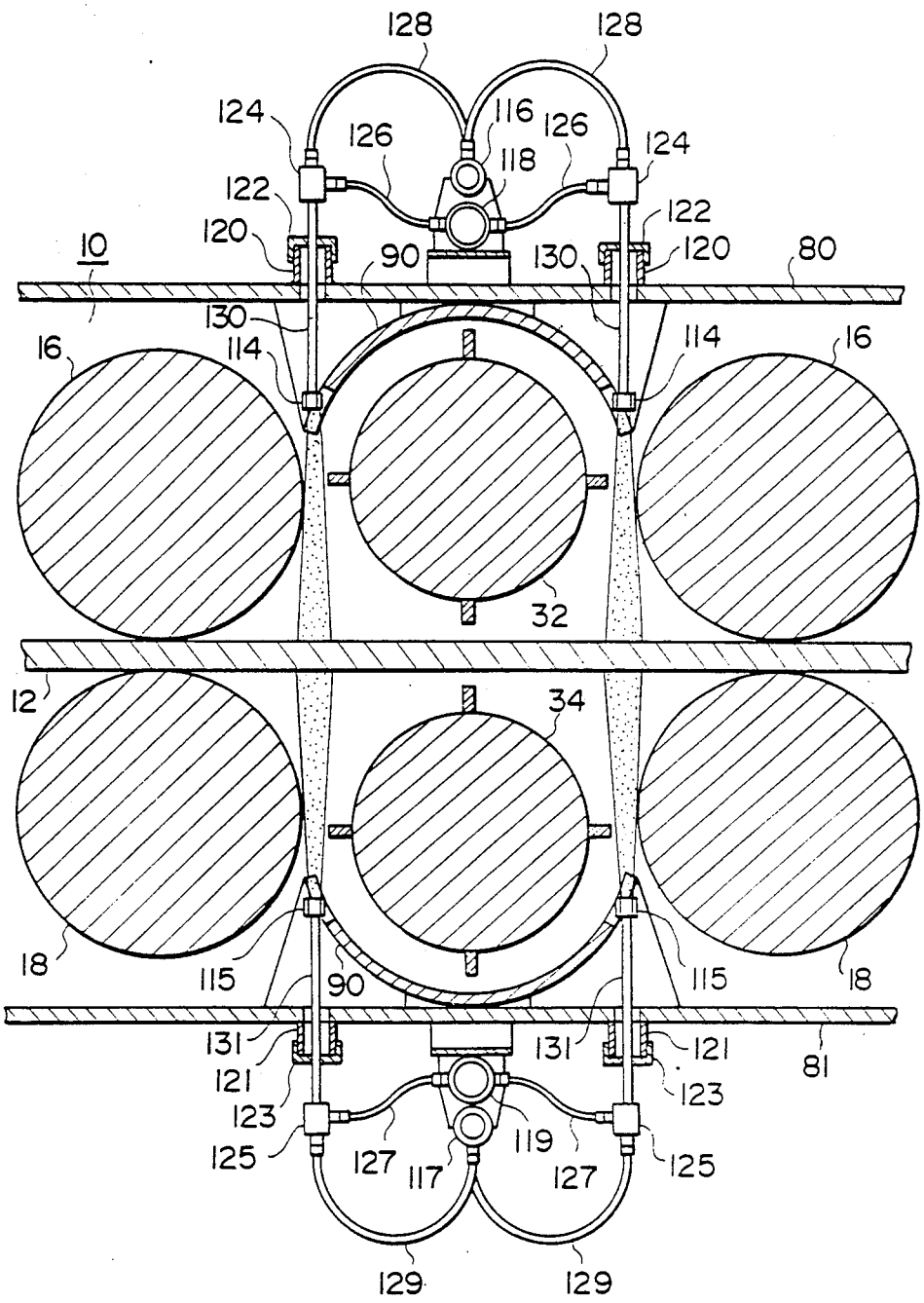
FIG. 18 is an enlarged sectional view of a continuous steel plate quenching apparatus in accordance with a fifth embodiment of the invention.

A fifth embodiment of the invention will be made hereinunder with specific reference to FIGS. 18 to 21. Referring first to FIG. 18 schematically showing the construction, the water storage vessel 10 is provided with a ceiling plate 80 and a bottom plate 81. The water storage vessel 10 stores cooling water which is supplied thereto through a water supplying main pipe and the steel plate in hot state is made to pass through the water storage vessel so as to be quenched by the cooling water. Cooling water supplying pipes different from the water supplying main pipe are disposed in the water storage vessel 10. In addition, air supplying pipes 118 and 119 are disposed adjacent to the cooling water pipes 116,117. In this embodiment, the mixture of water supplied through the water supplying pipes 116,117 and compressed air supplied through the air supplying pipes 118,119 is jetted into the water storage vessel. More specifically, water-air jetting nozzles 114 and 115 are extended into the water storage vessel 10 through the ceiling plate 80 and the bottom plate 81 of the water storage vessel 10. These nozzles 114,115 are disposed between respective rolls 16,18 and associated impellers 32,34 at a predetermined distance from the corresponding surfaces of the steel plate. More specifically, the water-air jetting nozzles 114,115 are connected, through flow settling tubes 130,131 for passing the mixture flow of water and air, to caps 122,123 which are fitted to tubular nozzle mounts 120,121 communicating with openings formed in the ceiling plate 80 and bottom plate 81 of the water storage vessel 10. The water-air jetting nozzles 114,115 can be attached and detached to and from the nozzle mounts 120,121 on the ceiling plate 80 and the bottom plate 81, together with the caps 122 and 123. The ends of the flow settling tubes 130 and 131 opposite to the nozzles are connected, through mixers 124 and 125 and cooling water supplying pipes 128 and 129, to the cooling water supplying pipe 116 attached to an upper part of the ceiling plate 80 and to the cooling water supplying branch pipe 117 attached to the lower part of the bottom plate 81, respectively. The above-mentioned ends of the flow settling tubes 130 and 131 are connected also to the air supplying pipes 118 and 119 extended in a side-by-side relation to the cooling water supplying pipes 116,117, through mixers 124 and 125 and then through compressed air supplying branch pipes 126 and 127, respectively.

Figure 19:
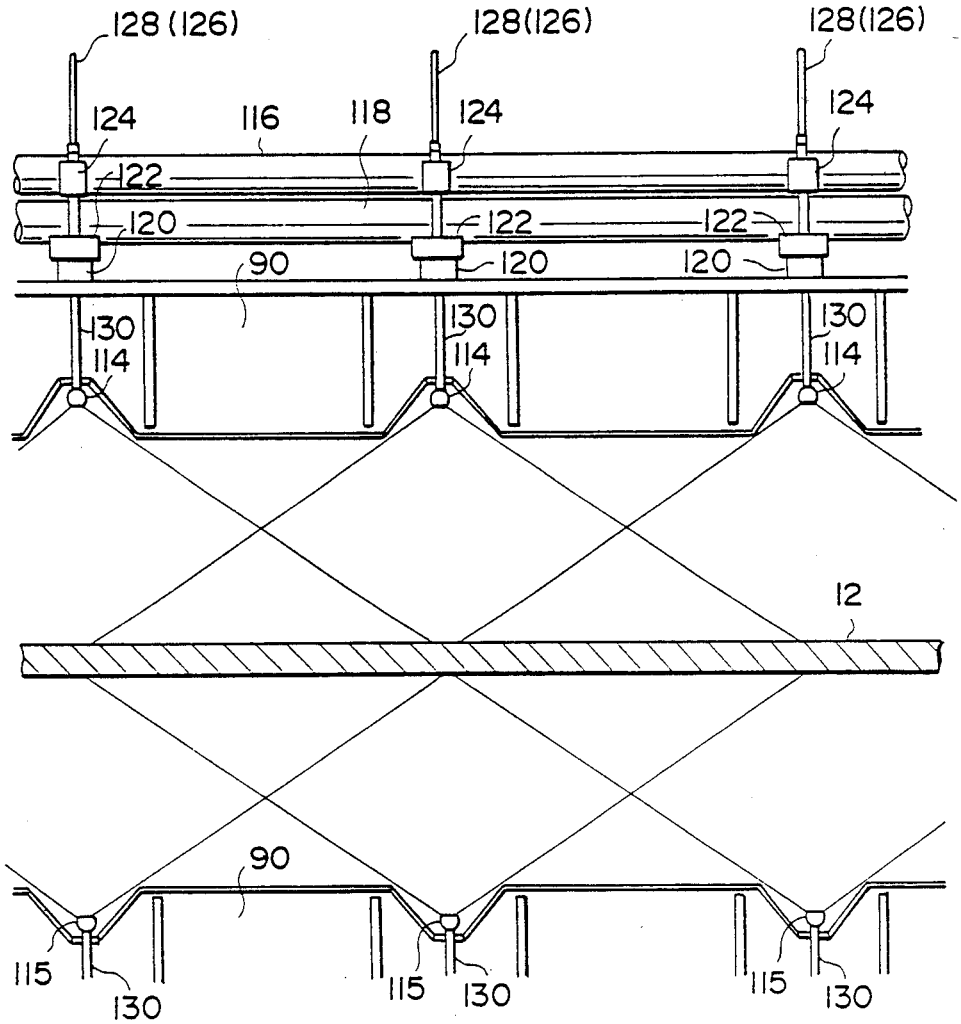
FIG. 19 is a schematic illustration showing the general arrangement of a two-fluid injection nozzle.

Preferably, the water-air jetting nozzles 114 and 115 are arranged such that the mixture flow jetted from these nozzles 114,115 do not interfere with the adjacent rolls 16,18, impellers 32,34 nor with the impeller guides 90 and that the spray pattern formed on respective sides of the steel plate 2 by the mixture fluid jetted from nozzles 114 and 115 spread over the entire breadth of the steel plate to be cooled, as will be seen from FIGS. 18 and 19.

Figure 20:
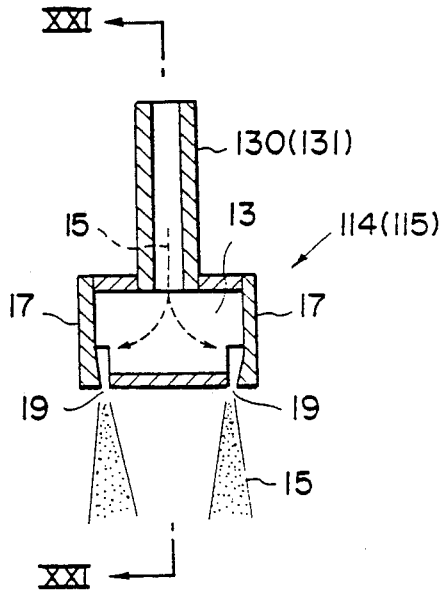
FIG. 20 is an enlarged sectional view of the nozzle.
Figure 21:
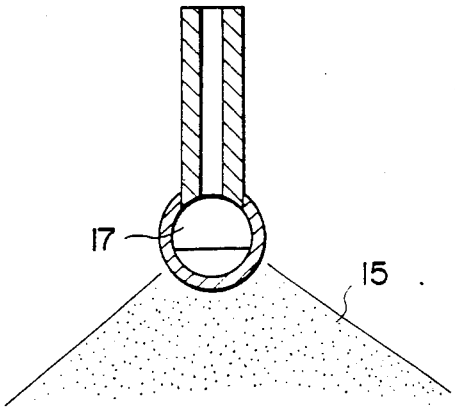
FIG. 21 is a sectional view taken along the line XXI—XXI of FIG. 20.

FIGS. 20 and 21 show the constructions of the water-air jetting nozzles 114 and 115. Namely, the arrangement is such that the mixture flow 15 of liquid and gas is introduced to pressure chambers 13 provided at the nozzle ends, through respective flow settling tubes 130 and 131. The pressure chamber 13 has a substantially cylindrical form and jets the mixture flow 15 through openings 19 formed in parts of circumference of both ends thereof. The pressure chamber 13 is closed at its both ends by means of caps 17.

According to this embodiment, the controlled cooling is effected in a manner explained hereinunder. The water storage vessel 10 is evacuated of or, alternatively, filled with the cooling water, and the mixture flow of the cooling water and compresed gas is applied to the obverse and reverse sides of the steel plate 12 to be quenched from the water-air nozzles 114 and 115. The flow rate and pressure of the water and compressed gas supplied to the water-air nozzles 114,115 are suitably changed and adjusted to meet the required cooling condition, by means of flow-rate adjusting devices and pressure adjusting devices which are disposed at intermediate portions of the supplying pipes 116,117,118 and 119.

As will be understood from the foregoing description, according to the continuous steel plate quenching apparatus of this embodiment having water-air jetting nozzles, it is possible to selevtively use either one of the water dipping quenching and water-air jet quenching or to use these two types of quenching in combination. It is, therefore, possible to eliminate the drawbacks in the construction and economy in the conventional quenching apparatus in which the cooling water moving type quenching or water-air jetting type quenching is used solely. In addition, it is possible to conduct a rapid and effective quenching by the simultaneous use of two quenching functions, and to easily make the control of the cooling by a comparatively simple arrangement by selectively using one of the two quenching functions or using two quenching functions simultaneously in combination.

Figure 22:
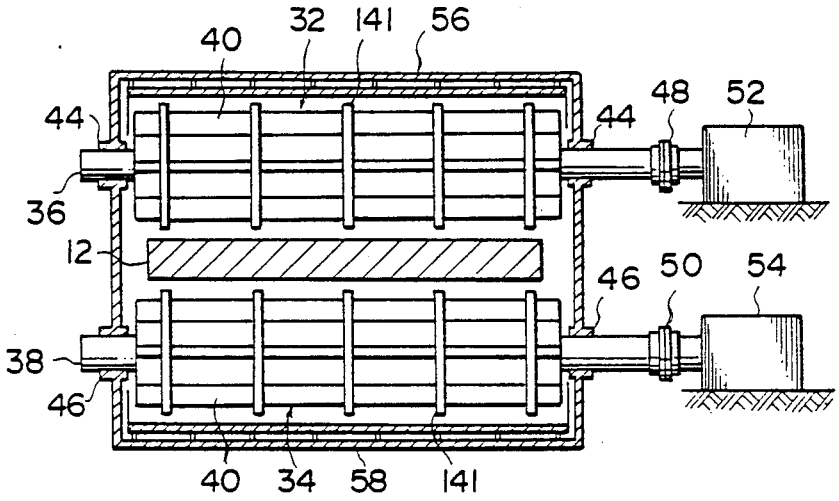
FIG. 22 is a sectional view of a continuous steel plate quenching apparatus in accordance with a sixth embodiment of the invention showing particularly another form of impeller.
Figure 23:
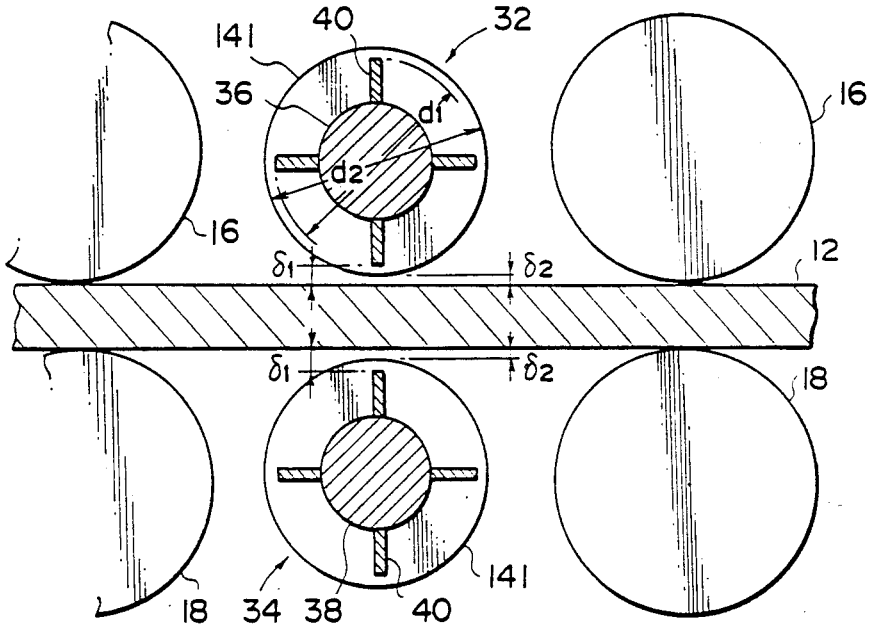
FIG. 23 is an enlarged sectional view of a part of the impeller shown in FIG. 22.

A sixth embodiment of the invention will be described hereinunder with reference to FIGS. 22 and 23. In this embodiment, each of the impellers 32 and 34 are provided with four blades 40 projected radially from the outer peripheral surface of the rotary shaft 36 and 38 thereof. Only a small gap $\delta_1$ on the order of several tens of milimeter or smaller is left between the blade 40 and the surface of the steel plate 12, thereby to eliminate the lack of uniformity of quenching effect attributable to any displacement of the cooling water in the axial direction of the impellers 32,33, i.e. in the breadthwise direction of the steel plate 12 which is clamped and fed by upper rolls and lower rolls 16 and 18. In each of the impellers 32 and 34, a plurality of rings 141 are attached coaxially to the outer peripheral surface of the rotary shaft 36 and 38 thereof at a predetermined pitch in the axial direction of the rotary shaft. The rings have an outside diameter $d_2$ which is greater than the diameter $d_1$ drawn by the outmost tip of the blades when the impeller rotates. The radius of the ring 141 as measured from the axis of the impeller is greater than that of the outmost tip of the blades 40 as measured from the axis of the impeller, but is small enough to prevent mechanical interference between the rings 141 and the steel plate. Namely, the distance $\delta_2$ between the ring 141 and the surface of the steel plate 12 is selected to be smaller than the distance $\delta_1$ between the blade 40 and the surface of the steel plate 12 and takes an order of less than several tens of millimeters.

In the illustrated embodiment, the axial pitch of the rings 141 is selected to range between 200 and 1000 mm, but this value is not exclusive and the axial pitch at which the rings are arrayed can be selected freely taking into account the factors such as the mechanical strength of the rings.

As will be understood from the foregoing description, in the continuous steel plate quenching apparatus of this embodiment, the undesirable mechanical interference between the blades and the steel plate surface is avoided even when the steel plate is warped or deflected during the quenching, because in such a case the surfaces of the steel plate 12 are contacted by the rings on the upper and lower impellers 16 and 18. Consequently, the damaging of the impellers and the steel plate surfaces, which often takes place in the conventional apparatus when the steel plate is accidentally warped or deflected, is avoided advantageously.

Figure 24:
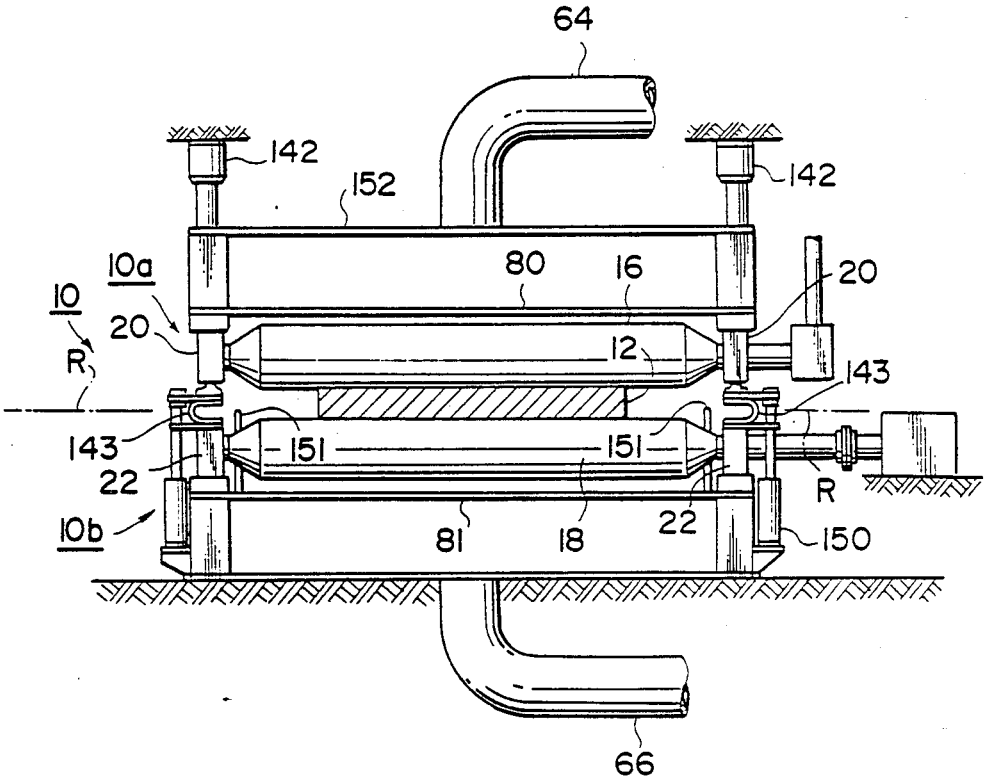
FIG. 24 is a sectional view of a continuous steel plate quenching apparatus in accordance with a seventh embodiment of the invention.
Figure 25:
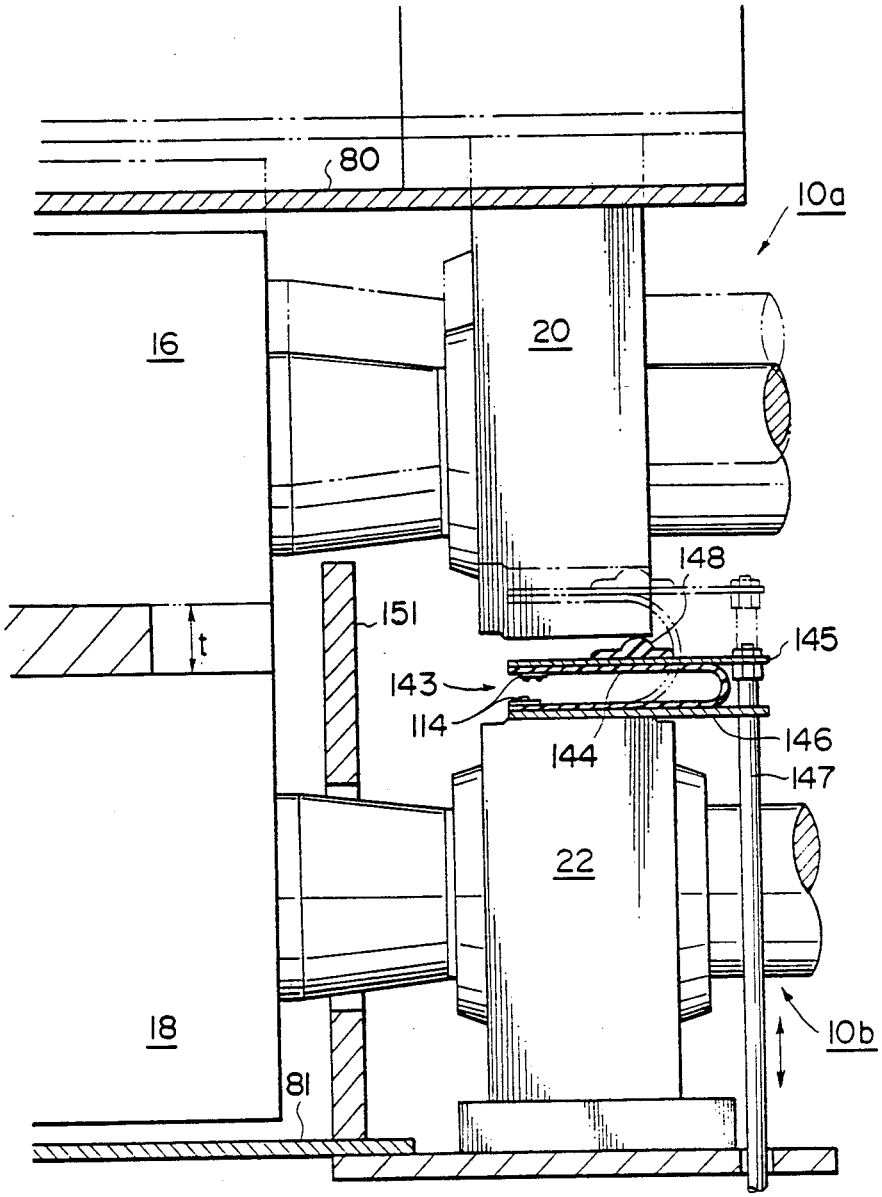
FIG. 25 is an enlarged sectional view of an essential part of the embodiment shown in FIG. 24.

FIGS. 24 and 25 show a seventh embodiment of the invention. In this embodiment, the water storage vessel 10 is divided into two sections: namely, an upper vessel **10*a* and a lower vessel 10*b* along the passage R of the steel plate to be quenched. The distance between the upper and lower vessels is adjustable by means of a lifting device 142, and two vessels are connected by means of a flexible seal members 143 the detail of which is shown in a larger scale in FIG. 25. As will be seen from this Figure, the seal member 143 is composed of a main body 144 having a substantially U-shaped cross-section and an upper plate 145 and a lower plate 146 which cooperate with each other in clamping therebetween the main body 144. The upper plate 145 is movable up and down by the operation of a supporting device 147. The upper plate 145 is provided on the upper surface thereof with a resilient member 148 adapted to make contact with the bottom surface of the upper vessel thereby to effect a seal therebetween. The main body 144 of the seal member is made of an elastic material such as a rubber, and is fixed at its both ends to the upper plate 145 and the lower plate 146 by means of suitable fixing means such as bolts, so that the main body 144 of the seal makes a deformation as shown by two-dot-and-dash line in FIG. 25 when the supporting device 147 is lifted, thereby to effect the seal. As will be seen from FIG. 24, the supporting device 147 is provided with a pneumatic cylinder 150** by which it is moved up and down.

In the quenching apparatus of the seventh embodiment having the described construction, it is possible to adjust the size or thickness of the openings in the water storage vessel 10 constituting the entrance and exit for the steel plate 12 in conformity with the thickness of the latter, by adjusting the distance between the upper and lower vessels **10*a* and 10*b* by the lifting device 142 and while maintaining water seal between the upper and lower vessels 10*a* and 10*b***. Furthermore, the installation area of the seal member can be reduced to realize a compact construction of the apparatus as a whole.

In the described embodiment of the invention, it is possible to pass a hot steel plate through the water storage vessel even when the latter does not contain cooling water. Namely, for passing a hot steel plate when the water storage vessel does not contain cooling water, the upper vessel **10*a* is lifted to a level as remote as possible from the path of the steel plate 12 by the lifting device 142, in order to minimize the influence of the heat radiated from the hot steel plate 12. On the other hand, the seal member 143 is lowered as much as possible by the pneumatic cylinder 150. In consequence, the seal member 143 is sufficiently freed from the heat radiated from the hot steel plate passing through the water storage vessel so that degradation or burning down of the seal member is avoided perfectly. The quenching apparatus of this embodiment can be provided with side guides at the inner sides of the supporting devices in order to prevent substantial winding of the steel plate to be quenched. Such side guides 151 effectively protects the seal member 143** against the heat radiated from the hot steel plate.

If the feed of hot steel plate under the absence of the cooling water in the water storage vessel is not conducted at all, it is possible to use springs for urging the upper plate 145 upwardly, in place of the pneumatic cylinders 150.

In FIGS. 24 and 25, reference numerals 64,66 denote water supplying pipes, 80 denotes a ceiling plate, 152 denotes a frame for suspending the upper vessel and 81 denotes a bottom plate. The quenching apparatus of this embodiment is provided with a water pool and overflow means which is neglected from the drawings.

Although the seal member 143 used in the illustrated embodiment incorporates a main body 144 having a substantially U-shaped cross-section, the invention does not exclude the use of other types of seal member. For instance, it is possible to use a seal member in the form of a tubular elastic member connected between the upper and lower vessels, the tubular elastic member being adapted to be expanded and contracted in response to the change in the distance between the upper and lower vessels.

As has been described, in the quenching apparatus of the described embodiment, the water storage vessel is divided into two parts: namely the upper vessel and the lower vessel so that the size or thickness of the openings constituting the entrance and exit are adjustable in conformity with the change in the thickness of the steel plate to be quenched advantageously.

Figure 26:
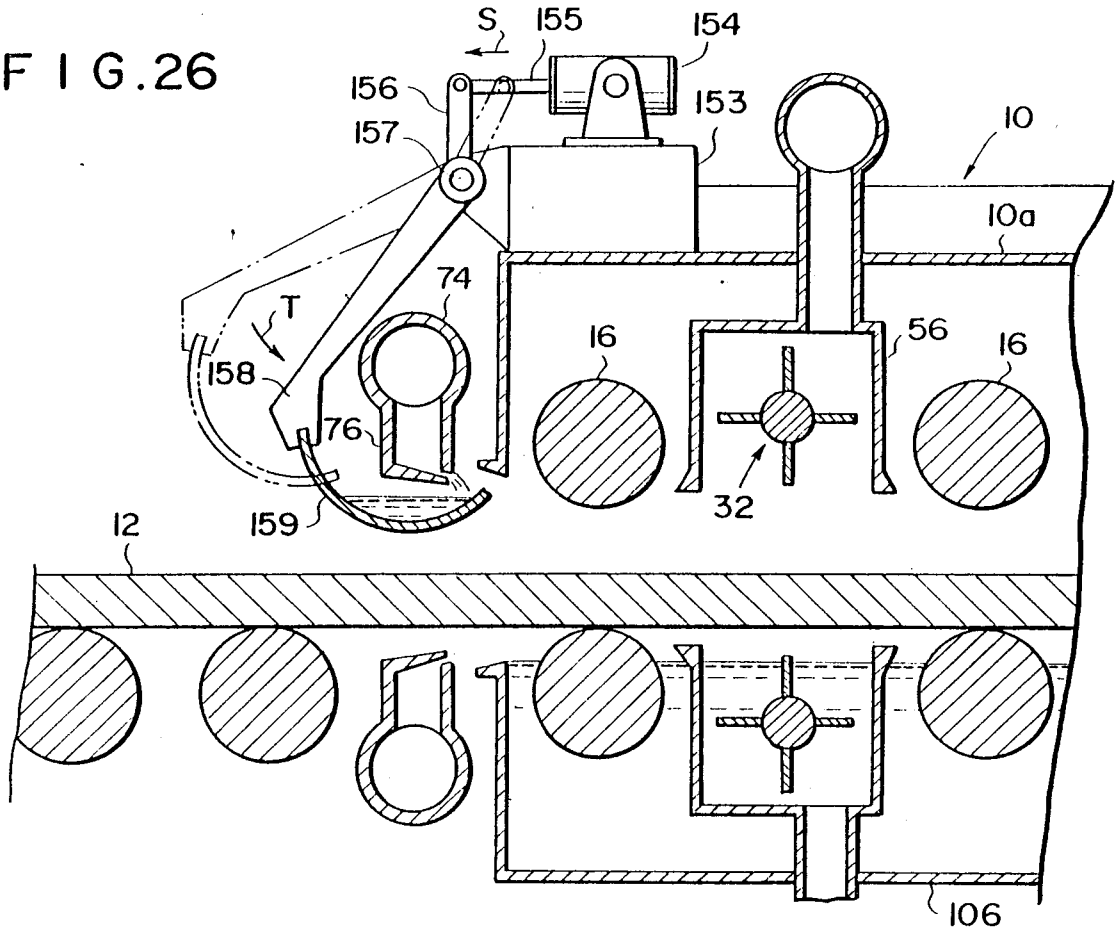
FIG. 26 is an enlarged sectional view of a nozzle protecting cover incorporated in a continuous steel plate quenching apparatus in accordance with an eighth embodiment of the invention.

FIG. 26 is an enlarged sectional view of inlet side of a continuous steel plate quenching apparatus of an eighth embodiment, having a nozzle protective device. When the hot steel plate 12 which is not intended for quenching is passed through the quenching apparatus, the upper structures of the apparatus such as rolls 16, impellers 32, impeller housings 56, slit nozzles 76 connected to the water supplying pipes 74 and so forth are moved upwardly together with the upper vessel 10*a* of the split type vessel 10, by the operation of a lifting device which is omitted from this Figure. On the other hand, the lower vessel 10*b* is charged with cooling water up to a level below the pass line as illustrated, while the upper vessel 10*a* is completely evacuated. In order to prevent any thermal distortion by the heat radiated from the hot steel plate, the upper rolls 16 and the upper impellers 32 are rotated at low speed. Furthermore, by operating a driving device 154 mounted on the upper frame 153, a rod 155 is pushed out in the direction of arrow S, so that a supporting arm 158 is swung in the direction of arrow T around a fulcrum 157 through the action of a link plate 156, so that a nozzle cover 159 made of a steel is tilted to the lower side of the upper slit nozzle 76. The nozzle cover 159 thus provided has a trough-like shape and is extended continuously in the longitudinal direction of the slit nozzle 76, i.e. in the breadthwise direction of the steel plate. The length of the nozzle cover 159 is large enough to cover the entire length of the slit nozzle 76. Therefore, the slit nozzle 76 is completely sheltered from the heat radiated from the hot steel plate 12 passing through the path below the slit nozzle 76, by the presence of the nozzle protection cover 159. The deformation of the slit nozzle 76, therefore, is avoided completely.

Preferably, the nozzle cover 159 is supplied with small rate of cooling water from the slit nozzle 76 so as to be cooled by the cooling water. In such a case, the cooling water is made to flow along the length of the nozzle cover 159 so as not to drop onto the steel plate 12 moving along the path below the nozzle cover 159, and is discharged from a lateral side of the continuous steel plate quenching apparatus. By adopting this construction, it is possible to prevent any thermal distortion of the nozzle cover 159 and, hence, prolong the life of the latter.

Needless to say, the nozzle cover serves not only to prevent the thermal distortion of the slit nozzle 76 but also to effectively prevent damaging of the slit nozzle 76 attributable to a direct mechanical contact with the leading end of the steel plate or an upward protrusion of the steel plate when the latter has been warped, during the passage of the steel plate. The nozzle cover may be held in the position indicated by two-dots-and-dash line during the quenching by the continuous quenching apparatus, so as to prevent any possible mechanical interference between the upper slit nozzle 76 and the steel plate 12 and to serve as a guide for smoothly introducing the steel plate 12 into the quenching apparatus. Other portions of this quenching apparatus are not described in detail because they are materially identical with those of the conventional apparatus.

As will be understood from the foregoing description, in the continuous steel plate quenching apparatus of this embodiment having the nozzle cover, it is possible to prevent any mechanical interference between the steel plate and the slit nozzle during the quenching and, in addition, to prevent undesirable thermal distortion of the slit nozzle by the heat radiated from the hot steel plate, as well as mechanical interference between the slit nozzle and the steel plate, when the hot steel plate which is not intended for quenching is made to pass through the quenching apparatus. In consequence, according to this embodiment, it is possible to smooth the quenching operation, as well as the feed of the hot steel plate when the latter is not quenched, and to effectively protecting the slit nozzle to remarkably reduce the repairing cost.

Figure 27:
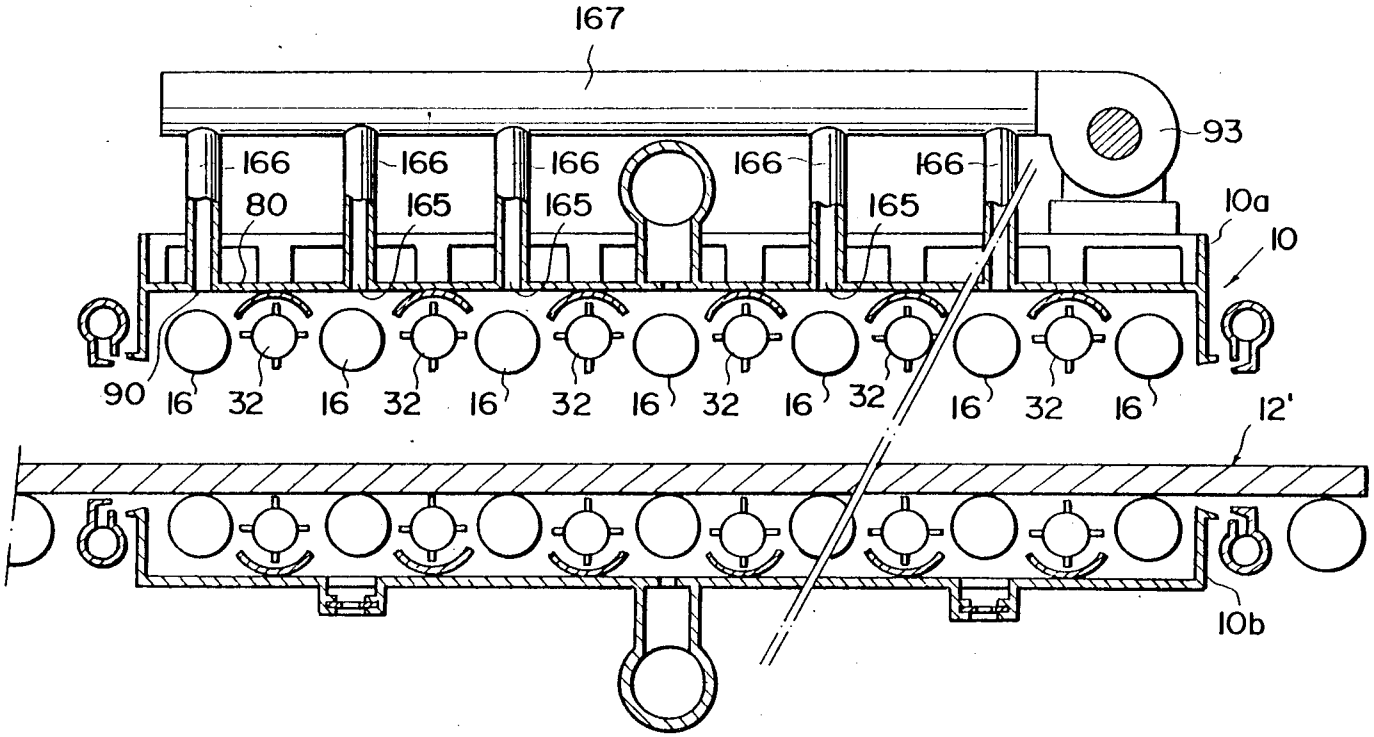
FIG. 27 is a sectional view of a continuous steel plate quenching apparatus in accordance with a nineth embodiment of the invention.

FIG. 27 shows a continuous steel plate quenching apparatus in accordance with a nineth embodiment of the invention. In this embodiment, as will be seen from this Figure, the upper vessel 10*a* accomodating the upper rolls 16 and upper impellers 32 are moved to and kept at elevated position by a lifting device which is not shown when the quenching is not made on the hot steel plate running through the quenching apparatus, in order to prevent any thermal distortion of the upper slit nozzles by the heat radiated from the hot steel plate, as well as damaging of the slit nozzles due to mechanical interference with the steel plate. In such a case, the upper rolls 16 and the upper impellers 32 are rotated at low speeds to prevent to some extent the thermal distortion thereof by the heat radiated from the hot steel plate 12 running along the path below the upper rolls 16 and upper impellers 32. However, the upper vessel 10*a* constituting a part of the water storage vessel is heated to an extremely high temperature, because the upper vessel 10*a*, which is closed at its top by the ceiling plate 80 and at its sides by bearings (not shown) for the upper rolls 16 and upper impellers 32, does not permit the air therein to be replaced with fresh air so that the air confined in this upper vessel is heated to a high temperature. In consequence, the upper vessel and the associated members are heated and thermally distorted undesirably.

To obviate this problem, the continuous steel plate quenching apparatus of the nineth embodiment is provided with means for effecting a forcible air cooling on the upper vessel 10*a* and various parts mounted in the latter. More specifically, the ceiling plate 80 of the upper vessel 10*a* is provided with a plurality of blowing openings 165 to which connected is a main blowing pipe 167 through respective blowing branch pipes 166. The blowing main pipe 167 is disposed above the ceiling plate 80 of the upper vessel 10*a*. As will be seen from the Figure, the blowing main pipe 167 is closed at its one end while the other end is connected to a blower 168 carried by the upper vessel 10*a*. In operation, the air is blown by the blower 168 into the upper vessel 10*a* through the main pipe 167, branch pipes 166 and the blowing openings 165 thereby to expel the air in the upper vessel 10*a*. In consequence, the excessive temperature rise of the atmosphere in the upper vessel 10*a* and, hence, the temperature rise and thermal distortion of the upper vessel 10*a* and equipments in the latter are avoided effectively.

As will be understood from the foregoing description, in the nineth embodiment of the invention, the formation of atmosphere of extremely high temperature in the upper vessel 10*a* is perfectly avoided even when the hot steel plate which is not intended for quenching is made to pass through the quenching apparatus, because cold air is continuously supplied into the upper vessel 10*a* to force out the heated air therefrom. In addition, this cold fresh air effectively cools the equipments in the upper vessel to prevent undesirable thermal distortion of these equipments attributable to the heating by the heat radiated from the hot steel plate. Furthermore, since the temperature change of these equipments is minimized, the undesirable phenomenon such as peeling off of the paint is avoided and the life of the quenching apparatus as a whole is increased remarkably.

Figure 28:
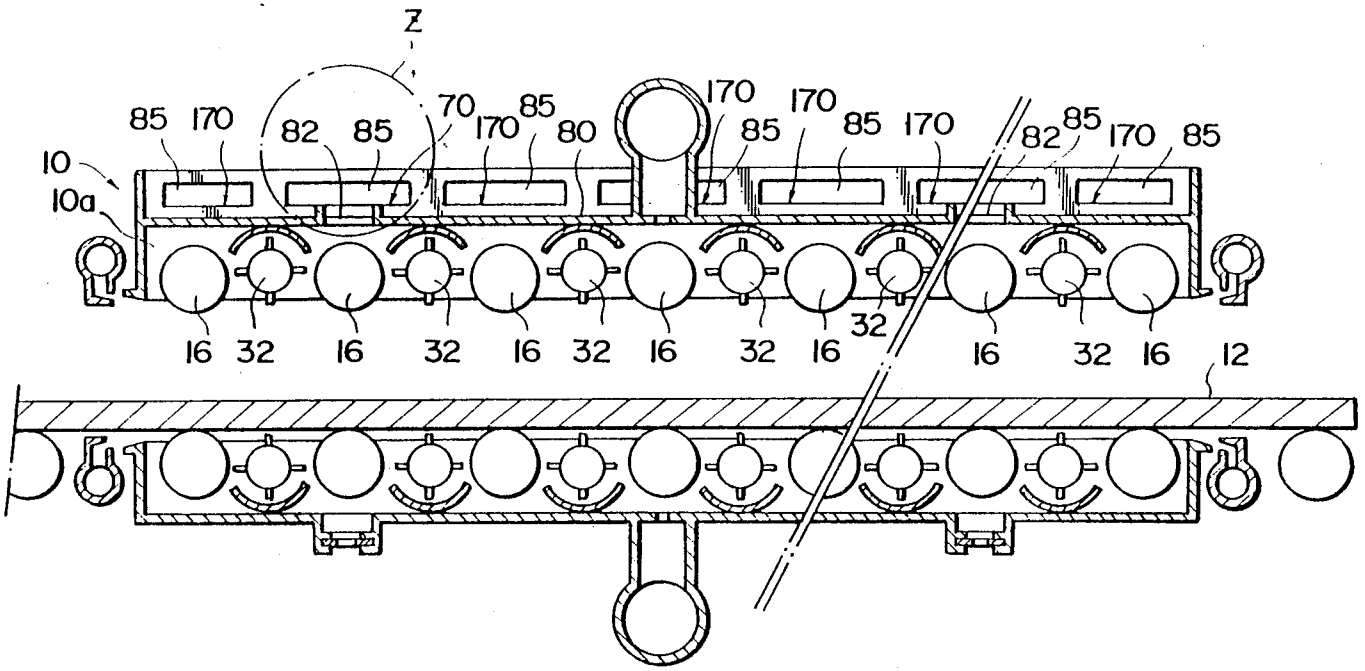
FIG. 28 is a sectional view of a continuous steel plate quenching apparatus in accordance with a tenth embodiment of the invention.
Figure 29:
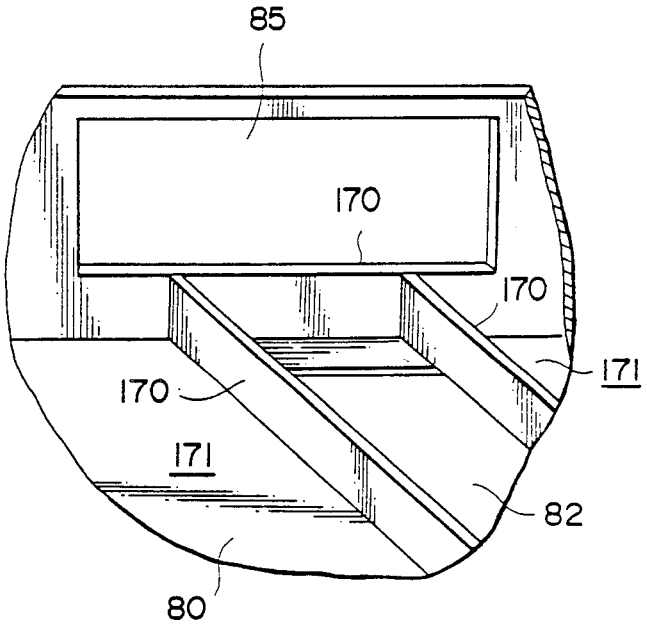
FIG. 29 is an enlarged perspective view of a encircled by a circle Z in FIG. 28.

FIGS. 28 and 29 in combination show a continuous quenching apparatus of a tenth embodiment of the invention. In this quenching apparatus, dams or sheeting plates 170 of a height substantially less than 100 mm formed around the water exhausting openings 85 in the ceiling plate and around the overflow openings 82 provided in the ceiling plate 80, thereby to form tubs 171 for holding cooling water on the ceiling plate 80. According to this arrangement, the ceiling plate 80 is effectively cooled by the water held in the tubs, so that undesirable thermal distortion of the ceiling plate is avoided advantageously. In the quenching apparatus of this embodiment, the water exhausting openings 85 are formed in the upper side walls of the ceiling plate 80 of the upper vessel 10*a* but not in the longitudinal ends of the upper vessel 10*a*.

In the continuous steel plate quenching apparatus of the tenth embodiment, the cooling water received by the tubs formed by the sheeting plates 170 on the ceiling plate 80 may be supplied externally through a specific piping. This positive supply of water into the tubs, however, is not always necessary because a part of the cooling water used in the quenching still remains in the tubs due to the presence of the sheeting plates 170, even after the discharge of the cooling water from the water storage vessel 10 upon completion of the quenching. The height of the sheeting plate is selected not to exceed 100 mm because the height exceeding 100 mm impractically increases the weight of the ceiling to require suitable reinforcement.

As will be understood from the foregoing description, according to the tenth embodiment of the invention, the ceiling plate of the water storage vessel is effectively cooled by the part of the cooling water used in the quenching and still remaining in the tubs formed on the ceiling plate, so that the undesirable heating and thermal distortion of the ceiling plate by the heat radiated from the steel plate 12 is avoided even when the hot steel plate which is not subjected to the quenching runs through the quenching apparatus. In consequence, it is possible to conduct the quenching in quite a smooth manner while maintaining the performance of the quenching apparatus for longer time, remarkably reducing the cost for the maintenance of the apparatus.

Although the invention has been described through specific terms, it is to be noted that the described embodiments are only illustrative and various changes and modifications may be imparted thereto without departing from the spirit or scope of the invention which is limited solely by the appended claims.

What is claimed is:

1. An apparatus for continuously quenching a steel plate by continuously cooling the steel plate with cooling water comprising:

a water storage vessel disposed in a feeding passage of the steel plate, said vessel containing circulated cooling water and having a ceiling and a bottom plate;

upper supplying openings disposed in the ceiling for supplying the cooling water into said vessel;

upper exhausting openings disposed in the ceiling for exhausting the cooling water from said vessel;

lower supplying openings disposed in the bottom plate for supplying the cooling water into said vessel;

lower exhausting openings disposed in the bottom plate for exhausting the cooling water from said vessel;

adjusting means for regulating an opening area of said lower exhausting openings;

a plurality of upper and lower rolls in said vessel for feeding the steel plate; and a plurality of upper and lower impellers in said vessel disposed in the vicinity of the steel plate for agitating and moving the cooling water on both surfaces of the steel plate at a predetermined speed with respect to the steel plate;

the cooling water for quenching substantially an upper portion of the steel plate being supplied from said upper supplying openings and exhausted from said upper exhausting openings, and the cooling water for quenching substantially a lower portion of the steel plate being supplied from said lower supplying openings and exhausted from said lower exhausting openings, the adjusting means preventing the cooling water from moving in a vertical direction in said vessel.

2. An apparatus for continuously quenching a steel plate as set forth in claim 1, further comprising;

a single upper water supplying pipe communicated with said upper supplying openings; and a single lower water supplying pipe communicated with said lower supplying openings.

3. An apparatus for continuously quenching a steel plate as set forth in claim 1, wherein said upper and lower exhausting openings are disposed uniformly at least along a direction perpendicular to the feeding direction of the steel plate.

4. An apparatus for continuously quenching a steel plate as set forth in claim 1, further comprising flow rate control means for controlling a supplying amount of the cooling water from said upper and lower supplying openings so that the cooling water is prevented from moving in a vertical direction in said vessel.

5. An apparatus for continuously quenching a steel plate as set forth in claim 1, further comprising flow rate detecting means for detecting a vertical flow of the cooling water in said vessel and opening said adjusting means.

6. An apparatus for continuously quenching a steel plate as set forth in claim 1, further comprising a plurality of impeller guides having an arcuate cross section and covering opposite side of said impellers from the steel plate.

7. An apparatus for continuously quenching a steel plate as set forth in claim 1, wherein each of said rolls comprises:

a central shaft; and a plurality of rings around outer periphery of said central shaft, said rings being disposed at equal interval with each other along an axial direction of said central shaft, whereby the steel plate is interposed between said rings of upper and lower rolls and a gap is formed between the steel plate and the outer periphery of said central shaft to allow the cooling water to flow therethrough.

8. An apparatus for continuously quenching a steel plate as set forth in claim 7, wherein said rings for said rolls next to each other are disposed in deviated positions in the axial direction of said central shaft.

9. An apparatus for continuously quenching a steel plate as set forth in claim 1, wherein each of said impellers comprises:

a rotary shaft; and a plurality of blades on outer periphery of said shaft extending substantially in the axial direction of said shaft, each of said blades being disposed along a hypothetical plane crossing the axis of said shaft at 30 degrees or less.

10. An apparatus for continuously quenching a steel plate a set forth in claim 9, wherein each of said blades is disposed along a hypothetical spiral plane crossing the axis of said shaft in the range of about 2–15 degrees.

11. An apparatus for continuously quenching a steel plate as set forth in claim 9, wherein each of said blades is disosed along a hypothetical plane crossing the axis of said shaft at 10 degrees or less.

12. An apparatus for continuously quenching a steel plate as set forth in claim 1, further comprising:

flow rate adjusting means for adjusting the flow rate of the cooling water into said vessel;

first temperature detecting means for detecting a temperature of the cooling water within said vessel;

control means for controlling said flow rate adjusting means in accordance with an output signal from said first temperature detecting means, whereby the temperature of the cooling water is kept at a substantially constant value.

13. An apparatus for continuously quenching a steel plate a set forth in claim 12, further comprising second temperature detecting means for detecting a temperature of the cooling water being supplied to the vessel, output signal of said means being supplied to said control means.

14. An apparatus for continuously quenching a steel plate as set forth in claim 1, further comprising a plurality of water-air injecting means for injecting a pressurized fluid including water and air onto both surfaces of the steel plate.

15. An apparatus for continuously quenching a steel plate as set forth in claim 14, wherein said water-air injecting means is selectively used as an alternative for the cooling water.

16. An apparatus for continuously quenching a steel plate as set forth in claim 1, wherein each of said impeller comprises:

a rotary shaft;

a plurality of blades on an outer periphery of said shaft extending substantially in an axial direction of said shaft; and a plurality of rings around the outer periphery of said shaft, said rings having a larger diameter than the diameter of a circle drawn by the outermost tips of said blades when said impellers rotate.

17. An apparatus for continuously quenching a steel plate as set forth in claim 16, wherein said rings are disposed at a substantially equal interval with each other in the axial direction of said shaft.

18. An apparatus for continuously quenching a steel plate as set forth in claim 1, wherein said vessel is divided into an upper vessel and lower vessel along the feeding passage of the steel plate, and a distance between said upper and lower vessels is adjustable.

19. An apparatus for continuously quenching a steel plate as set forth in claim 18, further comprising supporting means for supporting and vertically moving said upper vessel.

20. An apparatus for continuously quenching a steel plate as set forth in claim 18, further comprising a flexible seal member disposed between said upper and lower vessels.

21. An apparatus for continuously quenching a steel plate as set forth in claim 20, wherein said member is a resilient member having a U-shaped cross section, convex portion of said member facing outside of said vessel.

22. An apparatus for continuously quenching a steel plate as set forth in claim 20, further comprising means for vertically moving said member.

23. An apparatus for continuously quenching a steel plate as set forth in claim 1, further comprising:

a pair of through openings in opposite walls of said vessel in the feeding passage of the steel plate;

upper and lower slit nozzles opposed to said through openings for sealing said through openings by injecting the cooling water from outside of said vessel and;

a nozzles protecting cover for covering at least a lower portion of said upper slit nozzle, said cover being pivotally supported on said vessel.

24. An apparatus for continuously quenching a steel plate as set forth in claim 23, wherein said cover is removed from said upper slit nozzle when quenching the steel plate and is pivotally placed between said upper slit nozzle and an upper surface of the steel plate when not quenching the steel plate.

25. An apparatus for continuously quenching a steel plate as set forth in claim 23, wherein said cover is trough-shaped so that said cover keeps water thereon when covering said upper slit nozzle.

26. An apparatus for continuously quenching a steel plate as set forth in claim 1, further comprising:

a plurality of blowing windows disposed in the ceiling of said vessel; and a blower communicated with said windows and introducing cooling air into said vessel through said windows.

27. An apparatus for continuously quenching a steel plate as set forth in claim 26, further comprising:

a plurality of blowing branch pipes communicated with said windows; and at least one blowing main pipe communicated with said branch pipes and said blower.

28. An apparatus for continuously quenching a steel plate as set forth in claim 1, further comprising a plurality of tubs on an upper surface of the ceiling of said vessel for holding the cooling water therein.

29. An apparatus for continuously quenching a steel plate as set forth in claim 28, wherein said tubs are defined by sheeting plates disposed around said upper exhausting openings.

30. An apparatus for continuously quenching a steel plate as set forth in claim 29, wherein the height of said sheeting plates is 100 mm or less.

31. An apparatus for continuously quenching a steel plate as set forth in claim 4, further comprising flow rate detecting means for detecting a vertical flow of the cooling water in said vessel and operating said adjusting means or flow rate control means.

* * * * *